US012320121B2

(12) United States Patent
Lenney

(10) Patent No.: US 12,320,121 B2
(45) Date of Patent: Jun. 3, 2025

(54) STEPPED GUTTER GUARD

(71) Applicant: Gutterglove, Inc., Franklin, TN (US)

(72) Inventor: Robert C. Lenney, Lincoln, CA (US)

(73) Assignee: GUTTERGLOVE, INC., Franklin, TN (US)

( * ) Notice: Subject to any disclaimer, the term of this patent is extended or adjusted under 35 U.S.C. 154(b) by 0 days.

(21) Appl. No.: 18/351,459

(22) Filed: Jul. 12, 2023

(65) Prior Publication Data

US 2023/0366207 A1 Nov. 16, 2023

Related U.S. Application Data

(63) Continuation of application No. 17/806,485, filed on Jun. 11, 2022, now Pat. No. 11,732,480, which is a continuation of application No. 16/917,868, filed on Jun. 30, 2020, now Pat. No. 11,391,047.

(60) Provisional application No. 62/869,053, filed on Jul. 1, 2019.

(51) Int. Cl.
*E04D 13/076* (2006.01)
*E04D 13/064* (2006.01)

(52) U.S. Cl.
CPC ..... *E04D 13/076* (2013.01); *E04D 13/064* (2013.01)

(58) Field of Classification Search
CPC . E04D 13/076; E04D 13/0765; E04D 13/064; E04D 13/0445; E04D 13/0725; E04D 13/0641; E04D 13/0643; E04D 13/068; E04D 13/0685; E04D 13/072
USPC ..... 52/12
See application file for complete search history.

(56) References Cited

U.S. PATENT DOCUMENTS

| | | | |
|---|---|---|---|
| 1,732,058 | A | 10/1929 | Martini |
| 2,229,381 | A | 1/1941 | Grow |
| 2,288,121 | A | 6/1942 | Sandmeyer |
| 2,569,568 | A | 10/1951 | Lipshaw |
| 2,674,961 | A | 4/1954 | Lake |
| 2,935,954 | A | 5/1960 | Matthews |
| 2,997,763 | A | 8/1961 | Serfass |
| 3,350,045 | A | 10/1967 | Mayers |
| 3,630,383 | A | 12/1971 | Reeves |
| 3,691,343 | A | 9/1972 | Norman |
| 3,925,264 | A | 12/1975 | Corte |

(Continued)

FOREIGN PATENT DOCUMENTS

| | | |
|---|---|---|
| AU | 2013201320 | 3/2013 |
| CA | 1310167 | 11/1992 |

(Continued)

OTHER PUBLICATIONS

Valor Gutter Guard's Melt Away Use Guide, published Apr. 2014.

*Primary Examiner* — Babajide A Demuren
(74) *Attorney, Agent, or Firm* — Jonathan Kidney; Glen Gross; Intelink Law Group, PC

(57) ABSTRACT

A self-supporting gutter guard having a roof attachment, step, trough and gutter lip attachment sections. The step section is composed of a plurality of steps with orifices disposed in one or more treads of the steps, and in the trough. The trough floor is at a lower elevation and wider than a tread of the last step section and below a top of the gutter lip attachment section. The trough and the gutter lip attachment sections share a common wall. The device provides an uneven surface for easier debris drying and removal and is oriented at a downward angle from the roof attachment portion to the trough section.

40 Claims, 31 Drawing Sheets

(56) References Cited

U.S. PATENT DOCUMENTS 4,254,595 A 3/1981 Crossien
4,308,696 A 1/1982 Schroeder
4,435,466 A 3/1984 Kuhnel et al.
4,573,290 A 3/1986 Fleming
4,604,837 A 8/1986 Beam
2,583,422 A 3/1987 Burns
4,646,488 A * 3/1987 Burns ..... E04D 13/0459 52/12
4,745,710 A 5/1988 Davis
4,750,300 A 6/1988 Winger
4,755,229 A 7/1988 Armanini
4,769,526 A 9/1988 Taouil
4,827,686 A 5/1989 Stamper
4,941,299 A 7/1990 Sweers
D310,259 S * 8/1990 Hitchins ..... D23/267
4,949,514 A 8/1990 Weller
4,954,015 A 9/1990 McGowan
4,959,932 A 10/1990 Pfeifer
5,010,696 A 4/1991 Knittel
5,035,092 A 7/1991 Brant
5,038,528 A 8/1991 Brant
5,044,581 A 9/1991 Dressler
5,067,675 A 11/1991 Brant
5,092,086 A 3/1992 Rognsvoog, Sr.
5,098,045 A 3/1992 Pepper
5,107,635 A 4/1992 Carpenter
5,109,640 A 5/1992 Creson
5,127,200 A 7/1992 Doran
5,181,350 A 1/1993 Meckstroth
5,216,852 A 6/1993 Bemis et al.
5,228,247 A 7/1993 Dressler
5,257,482 A 11/1993 Sichel
5,261,195 A 11/1993 Buckenmaier
5,315,090 A 5/1994 Lowenthal
5,371,979 A 12/1994 Kwiatkowski et al.
5,375,379 A 12/1994 Meckstroth
5,391,858 A 2/1995 Tourangeau et al.
5,398,464 A 3/1995 Jacobs
5,406,754 A 4/1995 Cosby
5,406,756 A 4/1995 Bemis et al.
5,438,803 A 8/1995 Blizard, Jr.
5,459,965 A 10/1995 Meckstroth
D364,338 S 11/1995 Cline
5,522,185 A 6/1996 Cline
D372,421 S 8/1996 Cline
5,558,705 A 9/1996 Keemer et al.
5,570,557 A 11/1996 Kwiatkowski et al.
5,617,678 A 4/1997 Morandin
5,640,809 A 6/1997 Iannelli
5,729,931 A 3/1998 Wade
5,759,255 A 6/1998 Venturini et al.
5,836,117 A 11/1998 Johnson
5,842,311 A 12/1998 Morin
5,842,469 A 12/1998 Rapp et al.
5,848,857 A 12/1998 Killworth et al.
5,878,533 A 3/1999 Swanfeld
5,893,240 A 4/1999 Ealer, Sr.
D418,403 S 1/2000 Cline
D419,863 S 2/2000 Mullane
6,035,587 A 3/2000 Dressler
6,134,843 A 10/2000 Tregear
6,194,049 B1 2/2001 Bindschedler-Galli et al.
6,194,519 B1 2/2001 Blalock et al.
6,205,715 B1 3/2001 Rex
6,225,600 B1 5/2001 Burris
6,223,777 B1 6/2001 Smith et al.
6,266,929 B1 7/2001 Cline
6,341,462 B2 1/2002 Kiik et al.
D457,423 S 5/2002 Mullane
6,412,228 B1 7/2002 Meckstroth
6,468,613 B1 10/2002 Kitano
D475,613 S 6/2003 Mullane
6,598,352 B2 7/2003 Higginbotham
6,607,781 B2 8/2003 Joedicke et al.
D481,929 S 11/2003 McNichol
6,543,729 B1 11/2003 Ylonen
6,700,098 B1 3/2004 Wyatt et al.
6,708,452 B1 3/2004 Tenute
6,759,630 B1 7/2004 Tenute
D494,461 S 8/2004 Dressler
D495,595 S 9/2004 Dressler
D499,331 S 12/2004 Dressler
6,933,007 B2 8/2005 Fensel et al.
6,942,419 B2 9/2005 Knak et al.
6,944,991 B2 9/2005 Kim
6,944,992 B2 9/2005 Brochu
6,951,077 B1 10/2005 Higginbotham
6,951,323 B1 10/2005 McNichol
D511,451 S 11/2005 Mullane
6,959,512 B2 11/2005 Cobb
D514,670 S 2/2006 Handley
7,017,614 B2 3/2006 Handley
D519,025 S 4/2006 Dressler
7,056,422 B2 6/2006 Swistun
7,104,012 B1 9/2006 Bayram
7,127,852 B1 10/2006 Dressler
7,174,677 B1 2/2007 Dressler
7,174,688 B2 2/2007 Higginbotham
7,191,564 B2 3/2007 Higginbotham
7,241,500 B2 7/2007 Shiao et al.
7,310,912 B2 12/2007 Lenney
7,340,863 B1 3/2008 Dressler
7,434,358 B2 10/2008 Smith
7,448,167 B2 11/2008 Bachman
7,493,686 B2 2/2009 Barford
7,516,576 B1 4/2009 Mullane
7,597,119 B2 10/2009 Boettner
7,624,541 B2 12/2009 Gentry
7,677,271 B2 3/2010 Boettner
7,726,076 B2 6/2010 Staub
7,793,465 B2 9/2010 McCann
7,913,458 B2 3/2011 Higginbotham
D638,920 S 5/2011 Ealer, Sr.
7,975,435 B2 7/2011 Lenney
8,033,058 B2 10/2011 Block
8,079,183 B2 12/2011 Lenney
8,251,302 B2 8/2012 Sloan, Jr.
8,276,321 B2 11/2012 Bell
8,312,677 B2 11/2012 Higginbotham
D672,016 S 12/2012 Walker
8,418,410 B2 4/2013 Martin
8,438,788 B2 5/2013 Bell et al.
8,479,454 B2 7/2013 Lenney
8,495,837 B2 7/2013 McCoy
8,572,899 B1 11/2013 Pearce et al.
8,607,827 B2 12/2013 Bell
8,677,694 B2 3/2014 Ash
8,689,837 B1 4/2014 Smith
D709,357 S 7/2014 Bell
8,782,960 B2 7/2014 Nark
9,080,328 B1 7/2015 Smith
9,127,463 B1 9/2015 Feldhaus
D752,722 S 3/2016 Boettner
9,309,995 B2 4/2016 Bell
9,487,955 B2 11/2016 Breyer
D790,672 S 6/2017 Benjamin
9,890,535 B2 2/2018 Breyer
9,915,070 B2 3/2018 Lenney
9,976,309 B2 5/2018 Lenney
9,982,438 B2 5/2018 Casey
D819,790 S * 6/2018 Killian, Jr. ..... D23/267
10,081,937 B2 9/2018 Elliott
D837,048 S 1/2019 Benjamin et al.
10,233,647 B2 3/2019 Benjamin et al.
D878,189 S 3/2020 Benjamin et al.
2001/0054625 A1 12/2001 Iggulden
2003/0046876 A1 3/2003 Higginbotham
2003/0187539 A1 10/2003 Smith
2003/0198736 A1 10/2003 Fensel et al.
2005/0072114 A1 4/2005 Shiao et al.
2005/0235577 A1 10/2005 Smith
2005/0257432 A1 11/2005 Higginbotham
2005/0279036 A1 12/2005 Brochu
2006/0037252 A1 2/2006 Gosse et al.

(56) References Cited

U.S. PATENT DOCUMENTS

| | | | |
|---|---|---|---|
| 2006/0090404 | A1 | 5/2006 | Lovell |
| 2006/0117670 | A1 | 6/2006 | Tsioris |
| 2006/0179723 | A1 | 8/2006 | Robins |
| 2006/0196124 | A1 | 9/2006 | Bachman |
| 2006/0213129 | A1 | 9/2006 | Bachman |
| 2006/0230687 | A1 | 10/2006 | Ealer, Sr. |
| 2006/0277831 | A1 | 12/2006 | Bachman |
| 2006/0283096 | A1 | 12/2006 | Bachman |
| 2006/0288652 | A1 | 12/2006 | Gurr |
| 2007/0054129 | A1 | 3/2007 | Kalkanoglu et al. |
| 2007/0065640 | A1 | 3/2007 | Joedicke |
| 2007/0094939 | A1 | 5/2007 | Bachman |
| 2007/0107323 | A1 | 5/2007 | Higginbotham |
| 2007/0119104 | A1 | 5/2007 | Pijanowski |
| 2007/0199276 | A1 | 8/2007 | Duque |
| 2007/0218251 | A1 | 8/2007 | Jacobs |
| 2007/0220814 | A1 | 9/2007 | Faulks |
| 2007/0234647 | A1 | 10/2007 | Higginbotham |
| 2007/0246449 | A1 | 10/2007 | Bachman |
| 2007/0193012 | A1 | 11/2007 | Bergman et al. |
| 2008/0000169 | A1 | 1/2008 | Handley |
| 2008/0120921 | A1 | 5/2008 | McDonald |
| 2008/0134587 | A1 | 6/2008 | Ealer |
| 2008/0187708 | A1 | 8/2008 | Decker |
| 2008/0248241 | A1 | 10/2008 | Kalkanoglu et al. |
| 2009/0056234 | A1 | 3/2009 | Brochu |
| 2009/0064628 | A1 | 3/2009 | Mellott et al. |
| 2009/0139180 | A1 | 6/2009 | Kehs et al. |
| 2009/0300995 | A1 | 12/2009 | Nikolopoulos |
| 2010/0042579 | A1 | 2/2010 | Larsen et al. |
| 2011/0047930 | A1 | 3/2011 | Nark |
| 2011/0049118 | A1 | 3/2011 | Nark |
| 2011/0056145 | A1 | 3/2011 | Lenney |
| 2011/0067318 | A1 | 3/2011 | Lenney et al. |
| 2011/0138698 | A1 | 6/2011 | Neumann |
| 2011/0162289 | A1 | 7/2011 | Cangialosi |
| 2011/0253611 | A1 | 10/2011 | Higginbotham |
| 2012/0042579 | A1 | 2/2012 | McCoy |
| 2012/0049511 | A1 | 3/2012 | Bell et al. |
| 2012/0068452 | A1 | 3/2012 | Boettner |
| 2012/0144759 | A1 | 6/2012 | Higginbotham |
| 2012/0285115 | A1 | 11/2012 | Bell |
| 2013/0097943 | A1 | 4/2013 | Higginbotham |
| 2013/0160377 | A1 | 6/2013 | Sager |
| 2013/0160378 | A1 | 6/2013 | Higginbotham |
| 2013/0248672 | A1 | 9/2013 | Martin |
| 2013/0284650 | A1 | 10/2013 | Higginbotham |
| 2014/0013702 | A1 | 1/2014 | Pearce et al. |
| 2014/0130929 | A1 | 5/2014 | Elliott et al. |
| 2014/0196400 | A1 | 7/2014 | Bell |
| 2014/0263001 | A1 | 9/2014 | Higginbotham |
| 2015/0020462 | A1 | 1/2015 | Iannelli |
| 2015/0143756 | A1 | 5/2015 | Higginbotham |
| 2016/0201329 | A1 | 7/2016 | Ianelli |
| 2017/0089071 | A1 | 3/2017 | Smith et al. |
| 2018/0179761 | A1 | 6/2018 | Higginbotham |
| 2018/0283009 | A1 | 10/2018 | Stacye |

FOREIGN PATENT DOCUMENTS

| | | |
|---|---|---|
| CA | 2021168 | 2/2002 |
| CA | 2021169 | 2/2002 |
| CA | 2476351 | 11/2005 |
| CA | 2551297 | 12/2007 |
| CA | 2390777 | 5/2008 |
| CA | 2752598 | 3/2013 |
| EP | 1344640 | 4/2006 |
| EP | 2518226 | 10/2012 |
| FR | 2694775 | 11/1997 |
| GB | 2084210 | 4/1982 |
| JP | 06-146506 | 5/1994 |
| JP | 09228592 | 9/1997 |
| JP | 2000-008559 | 1/2000 |
| KR | 1989-10803 | 7/1989 |
| KR | 1989-23083 | 12/1989 |
| KR | 1998-16228 | 6/1998 |
| WO | WO1999053157 | 10/1999 |

* cited by examiner

STEPPED GUTTER GUARD

CROSS REFERENCE TO RELATED APPLICATION(S)

This application claims the benefit of and is a continuation of pending U.S. patent application Ser. No. 17/806,485, titled STEPPED GUTTER GUARD, filed Jun. 11, 2022, which claims priority to U.S. patent application Ser. No. 16/917,868 filed Jun. 30, 2020, now U.S. Pat. No. 11,391,047, which claims the benefit and priority of U.S. provisional application No. 62/869,053 titled "One-Piece Truss Gutter Bridge," filed on Jul. 1, 2019, wherein the above-identified applications are incorporated herein by reference in their entireties.

BACKGROUND

Field

This invention relates to gutter guards and protecting gutters from having debris entering the gutter but allowing water into the gutter.

Description of Related Art

Rain gutters are generally attached to buildings or structures that have a pitched roof. The gutters are designed to collect and divert rainwater that runs off the roof. The gutter channels the rainwater (water) to downspouts that are connected to the bottom of the gutter at various locations. The downspouts divert the water to the ground surface or underground drainage system and away from the building.

Gutters have a large opening, which runs parallel to the roofline, to collect water. A drawback of this large opening is that debris, such as leaves, pine needles and the like can readily enter the opening and eventually clog the gutter. Once the rain gutter fills up with debris, rainwater can spill over the top and unto the ground, which can cause water damage to a home and erode surrounding landscapes.

A primary solution to obstruct debris from entering a gutter opening is the use of debris preclusion devices, most commonly known in the public as gutter guards. Gutter guards are also generically referred to as gutter covers, eaves guards, leaf guards or, alternatively via the more technical terms gutter protection systems, debris obstruction device (DOD), debris preclusion devices (DPD) or gutter bridge, etc. Gutter guards/DOD types abound in the marketplace and the industry is constantly innovating to find more efficient configurations that not only keep debris, such as leaves and pine needles out of the gutter, but also even tiny roof sand grit. Concomitant with these innovations are the challenges of systems that are simple (e.g., low cost, easy to fabricate, etc.) as well as systems designed to maintain effectiveness (e.g., durable, easy-to-install, minimal maintenance, etc.) in heavy weather conditions.

In view of the above, various systems and methods are elucidated in the following description, that provide innovative solutions to one or more deficiencies of the art, including designs for stepped gutter guards.

SUMMARY

The following presents a simplified summary in order to provide a basic understanding of some aspects of the claimed subject matter. This summary is not an extensive overview and is not intended to identify key/critical elements or to delineate the scope of the claimed subject matter. Its purpose is to present some concepts in a simplified form as a prelude to the more detailed description that is presented later.

In one aspect of the embodiments of this disclosure, a single piece, gutter guard for covering a gutter attached to a building is provided, comprising: a roof attachment section; a gutter lip attachment section; a solid step section composed of a plurality of connected steps having treads and risers, and integrally connected to the roof attachment section; a trough integrally connected to a last step of the solid step section and to the gutter lip attachment section, wherein a floor of the trough has a width that is wider than a tread of the last step; and a plurality of orifices disposed in at least one of treads and risers of the connected steps and in the trough.

In another aspect of the embodiments of this disclosure, the above gutter guard is provided, wherein the trough and the gutter lip attachment section share a common wall; and/or wherein the floor of the trough is disposed below a top plane of the gutter lip attachment section; and/or wherein a height of the risers and a length of the treads are approximately equal; and/or wherein an angle of junctions between treads and risers is approximately 90 degrees; and/or wherein an angle of junctions between treads and risers is less than approximately 90 degrees; and/or wherein a rear of the treads are lower than a front of the treads; and/or wherein the plurality of orifices are disposed in junctions of the treads and risers; and/or wherein the plurality of orifices are disposed proximal to junctions of the treads and risers; and/or wherein the plurality of orifices in the trough are disposed adjacent to the common wall; and/or further comprising orifices disposed in the common wall; and/or wherein the plurality of orifices in the trough are disposed in a junction of the trough and the gutter lip attachment portion; and/or wherein the plurality of orifices are at least one row of orifices; and/or wherein the at least one rows are offset from each other; and/or wherein the orifices of the plurality of orifices are non-circular; and/or wherein an outside corner of the plurality of connected steps partially overhangs an orifice in a lower adjacent step's tread; and/or wherein an outside corner of the plurality of connected steps completely overhangs an orifice in a lower adjacent step's tread; and/or wherein an outside corner angle and inside corner angle the plurality of connected steps is less than 90 degrees; and/or wherein a tread width of the treads is greater than a riser height of the risers; and/or wherein one or more steps of the plurality of connected steps is at least one of a different size and different shape than another one or more other steps of the plurality of connected steps; and/or wherein one or more steps of the plurality of connected steps has at least one of a different inside corner and outside corner angle than another one or more other steps of the plurality of connected steps; and/or wherein the last step is at least one of larger, different in shape and different in angle than a first step of the step section; and/or further comprising a barrier in the trough; and/or wherein the barrier is one or more of at least one of raised, recessed and has an orifice in a bottom thereof; and/or wherein the barrier is at least one of formed from the floor of the trough and shaped as at least one of a circle, plurality of circles, rectangle, arrow head, arc, and starburst.

In yet another aspect of the embodiments of this disclosure, a single piece, gutter guard for covering a gutter attached to a building is provided, comprising: a roof-side attachment portion; a gutter lip attachment portion; a plurality of connected steps having treads and risers, spanning from the roof-side attachment portion to a trough, wherein the trough is connected to the gutter lip attachment section, and a floor of the trough is wider than a tread of a last step; and a plurality of orifices disposed proximal to a back of treads of the connected steps and disposed within the trough.

In yet another aspect of the embodiments of this disclosure, a single piece, gutter guard for covering a gutter attached to a building is provided, comprising: a roof-side means for attachment to at least one of a roof and building; a gutter-side means for attaching to a lip of a gutter; a plurality of stepped means, spanning from the roof-side means to proximal to the gutter-side means, wherein a last of the plurality of the stepped means is connected to a trough, the trough being connected to the gutter-side means, wherein a floor of the trough is wider than a tread of the last of the plurality of the stepped means; and a plurality of orifices disposed in the plurality of stepped means and disposed in the trough.

These and other features and advantages of this invention are described in, or are apparent from, the following detailed description of various exemplary embodiments of the devices and methods according to this invention.

BRIEF DESCRIPTION OF THE DRAWINGS

Various exemplary embodiment of this invention will be described in detail, with reference to the following figures, wherein.

DETAILED DESCRIPTION

Introduction

It should be appreciated that the most commonly used term to describe a debris obstruction (or preclusion) device (DOD) for a rain gutter is gutter guard. However, as stated above, alternate terms are used in the industry (generally from product branding), denoting the same or essentially same purpose of preventing or obstructing the entrance of external debris (e.g., non-water material) into the rain gutter, whereas the gutter can be protected so as to operate effectively. Thus, recognizing the layman may interchangeably use these terms to broadly refer to such devices, any such use of these different terms throughout this disclosure shall not be interpreted as importing a specific limitation from that particular "brand" or "type" of gutter device. Accordingly, while a DOD or gutter bridge may be a more technically accurate term, unless otherwise expressly stated, the use of the term gutter guard, gutter cover, leaf guards, leaf filter, gutter protection systems, gutter device, gutter guard device, and so forth, may be used herein without loss of generality.

Figure 1:
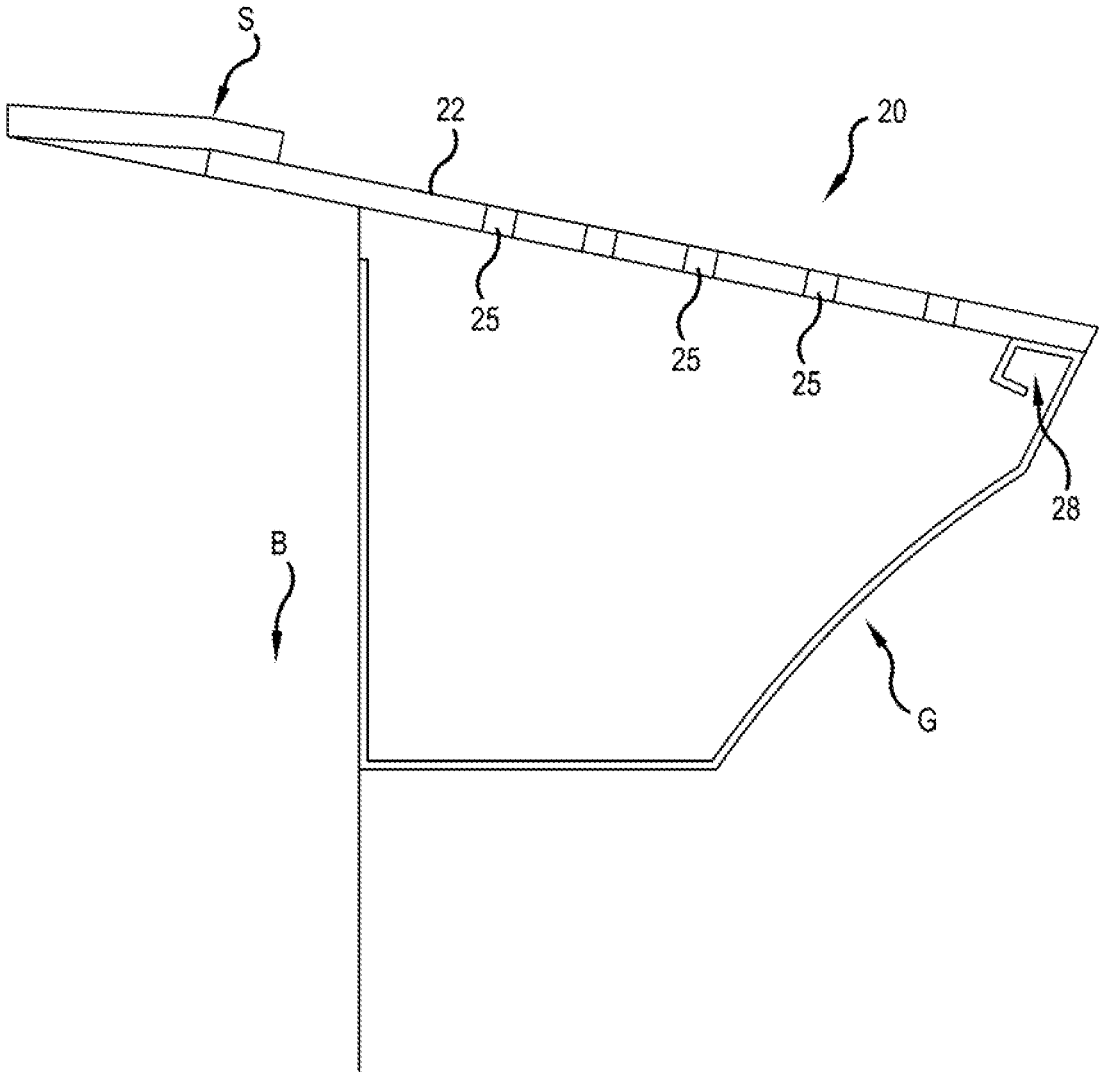
FIG.1 PRIOR ART
FIG. 1 is a side view illustration of an installed prior art gutter guard.

Many conventional gutter guard devices are made of a single planar piece of perforated sheet of aluminum and are designed to be installed in a primarily horizontal arrangement relative to the gutter. For example, FIG. 1 is an illustration of a commonly used conventional gutter guard device 20. The horizontal installation over the gutter G generally creates a flat surface 22 extending from the building B to the gutter lip 28 (the outer edge of the gutter). This flat surface 22 tends to encourage debris to accumulate on the gutter guard 20. This accumulation can and often clogs the holes 25 on the gutter guard 20, preventing water from penetrating the gutter guard 20 into the gutter G. Also, these types of conventional, flat, horizontal, gutter guards 20 can cause rainwater to wick back under roof shingles S once debris has accumulated on the guard 20. This wicking can cause extensive water damage to the building B. Still further, with the accumulation of debris and rainwater not being able to readily flow through the guard 20 and into the gutter G, the rainwater can flow across the guard 20 to the gutter lip 28, and then undesirably over the gutter G.

Designs of gutter guard devices are in a constant battle of balancing the size of the holes in the surface of the device so that water can be diverted into the gutter without having the holes be too large to allow debris to enter the gutter. Also, supporting the gutter guard over the gutter is challenging, wherein multiple support structures are also used. As debris entrance is undesired, conventional gutter guard devices tend to have a great number of small diameter holes per square inch. However, this design balance generally ends up reducing the rigidity of the device, often requiring separate supporting structures. Further, small diameter holes are easier to be obstructed with micro-debris and this eventually causes the water to flow over the holes and fall off the end of the gutter guard.

Conventional gutter guard devices have to be manufactured in multiple different sizes to fit generally used gutter sizes; a different sized gutter guard for each gutter size. Further, conventional guards are not readily modifiable to fit various building configurations.

Stepped Gutter Guards

In view of the above challenges for gutter guards, exemplary stepped designs are described herein including one-piece design(s) which are able to fit a 4", 4.5", 5" or 6" gutter, for example. As a "one-size fits" design is easier to stock on store shelves, retailers and sellers will appreciate the space savings. As the exemplary design is capable of fitting commonly sized gutters, homeowners will not need to climb to the roof to measure their gutter widths. Contractors do not have to be burdened with carrying multiple size guards to the job site. In various embodiments, the exemplary device's back section can be made to be flexible, thus able to be "bent" into a variety of angles to fit different roof/gutter mounting situations.

The below Figs. will have illustrations of various exemplary embodiments, however, it is noted that portions of the illustrations may not be to scale. That is, certain described elements may not be appropriately scaled with respect to other described elements. Or the described orientation or angles may not be as shown or if shown are not the exact value described. For example, certain cross sectional views or cut-away, for ease of viewability, are shown as a gap in the profile, the gap indicating the orifice or break in the structure. Whereas the gap would not be traditionally shown in a true cross sectional view. Further, lengths of certain elements, tread or riser for example, may not be true to scale, as well as the angles that define them.

Figure 2:
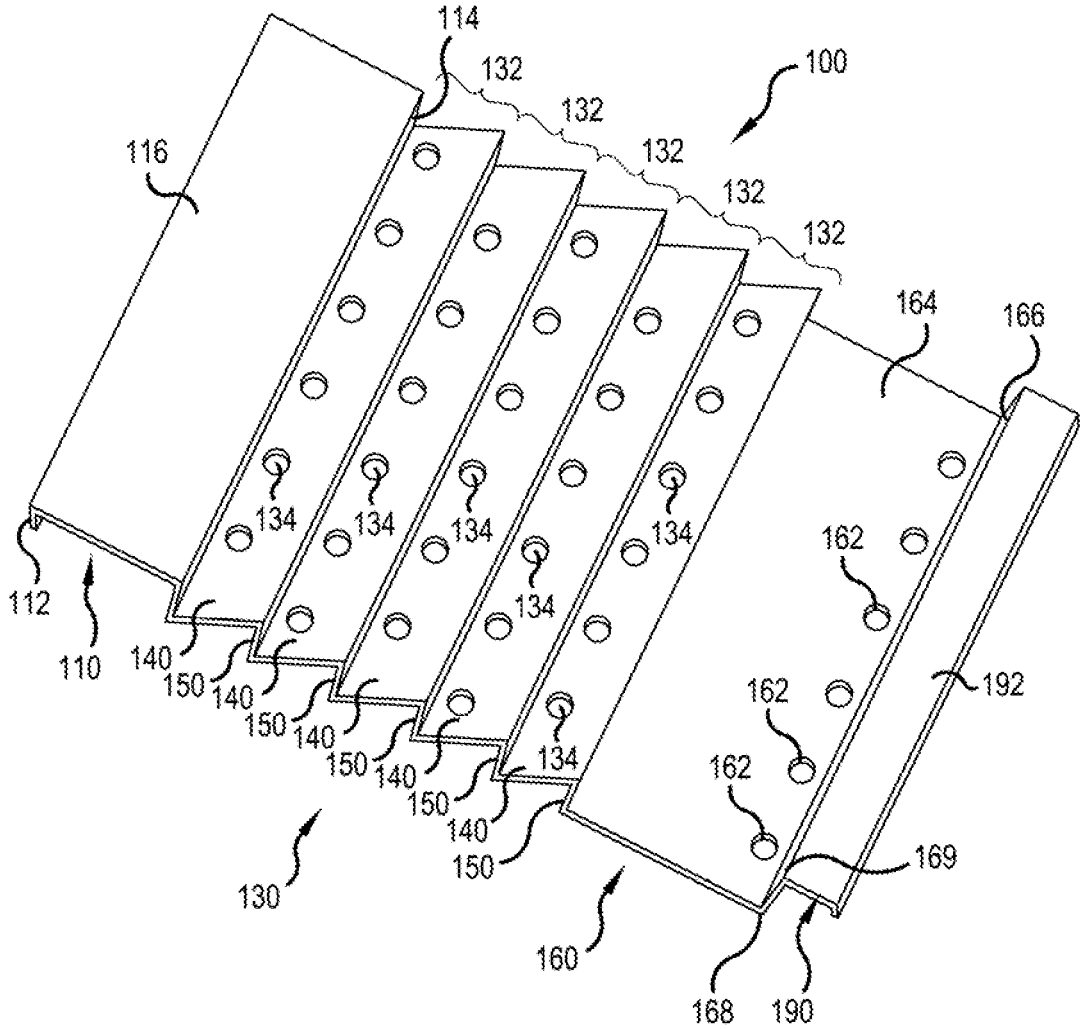
FIG. 2 is a perspective view illustration of an exemplary gutter guard.
Figure 3:
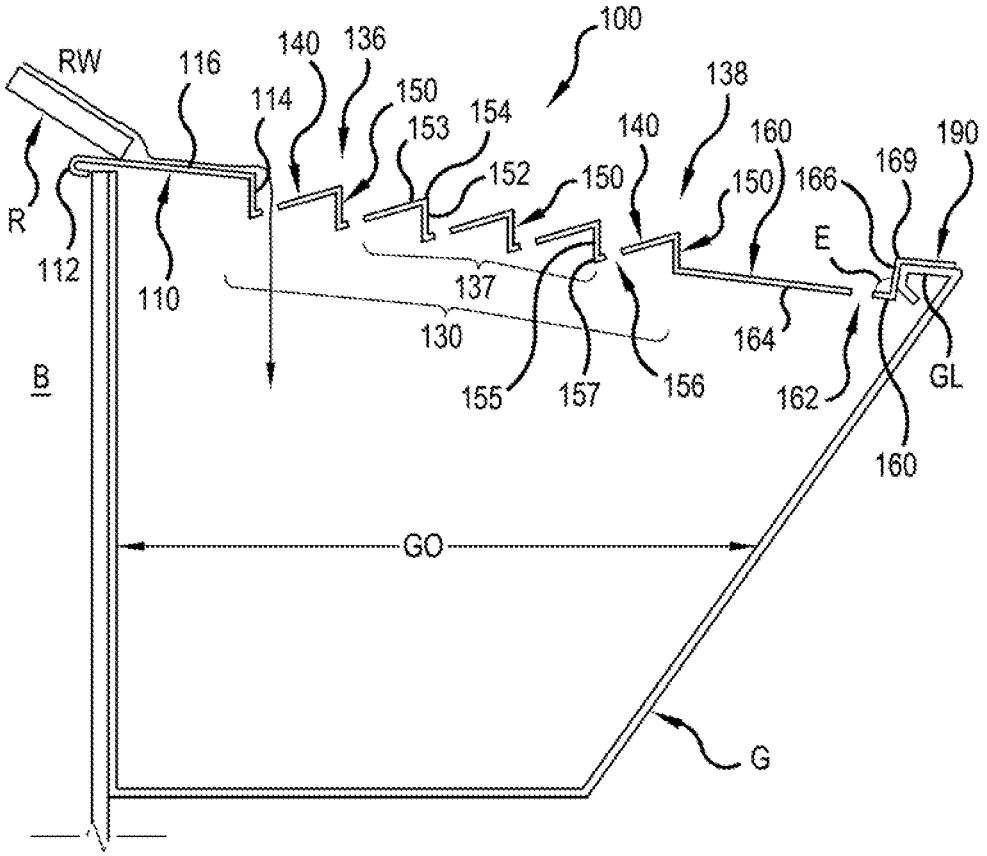
FIG. 3 is a side view illustration of the exemplary gutter guard of FIG. 2 over a gutter connected to a roof.

FIG. 2 displays a perspective view of an exemplary gutter guard device 100. FIG. 3 shows a partial cut-away side view of the exemplary device 100, installed on a gutter G, attached to building B, having a roof R. (It is noted here that FIG. 3's cut-away view illustrates the orifices as breaks in the continuity of the surface, but it is understood that this is done simply for ease of viewing.) The device 100 includes a roof attachment portion 110 connected to a step portion 130, connected to a trough portion 160 and connected to a gutter lip attachment portion 190. The device 100 can be made from a single piece of material, if so desired, or of several pieces joined together. For the embodiments described herein, portions 110, 130 and 190 principally define the exemplary device 100, with optional portion 160 added for other embodiments of the exemplary device 100. For ease of explanation, the following discussion will describe the exemplary device 100 with all the portions 110, 130, 160 and 190.

The roof attachment portion 110 includes an attachment portion riser 114 and an attachment tread 116. The "roof-side" of attachment portion riser 114 can be terminated with an optional attachment section 112, which can be attached to a side of building B. While FIGS. 2 and 3 show optional attachment section corner 112 as a lip, it is understood that it can be curled, a bead, tapered, U or L-shaped, bent, etc., according to design preference. For example, all or part of attachment section corner 112 and/or attachment tread 116 may of the form shown, for example, in FIGS. 30-32, of U.S. patent application Ser. No. 16/864,089, wherein it can be bent into a desired angle. When the device 100 is in use, attachment tread 116 can simply be slid under a roof's shingles or in some applications it can be bent to conform with and match the building B so that it can be fastened to the building B and/or the gutter G. In various embodiments herein, attachment tread 116 (at for areas neighboring the roof) is designed to be solid, without holes. If attachment tread 116 is sufficiently wide to have a region hanging over the gutter's G opening, holes may be devised in that region to allow drainage into the gutter G.

Attachment portion riser 114 connects to step portion 130, which includes a plurality of steps 132. Each of steps 132 has a plurality of orifices 134 formed therein. Step portion 130 is integrally connected to and disposed between roof attachment portion 110 and trough portion 160. The size of steps 132 within step portion 130 may be uniform between steps 132 or may vary, according to design preference.

Each step 132 of step portion 130 has a respective tread 140 and riser 150. In various embodiments, step orifices 134 are formed in tread 140 of each of steps 132, and usually (but not necessarily) disposed toward a roof-side end of each tread 140. It is expressly understood that the orifices shown in this disclosure can be circular, oval, rectangular, slots, ports, etc. and are not restricted to any particular shape. Further, the orifices can be formed in one or more rows or arrangements and formed by punching, machining, molding, and so forth. The orifices can also be of different sizes, types, shapes, etc. for different steps within step portion 130. In some embodiments, the orifice(s) or row of orifice(s) can be substituted with a segmented slots parallel to the tread.

In the embodiment shown in FIG. 2, a density of the step orifices 134 was approximately 18 orifices per linear foot. However, it is expressly understood that other densities, shapes, arrangements and locations of the step orifices 134 are possible, without departing from the spirit and scope of this disclosure.

Optional trough portion 160 is integrally connected to and disposed between step portion 130 and gutter lip attachment portion 190. Trough portion 160 is joined to step portion 130 via riser 150 of step portion 103's last step. Trough portion 160 includes a trough tread 164 and a gutter lip side trough riser 166. Trough tread 164 connects to trough riser 166 at junction or corner 168 which is below gutter lip attachment portion 190. Accordingly, trough portion 160 or at least corner 168 is below step portion 130 and/or gutter lip attachment portion 190. Angle E is formed on the upper surface of trough portion 160 between tread 164 and riser 166. In various embodiments, the angle E can range between 45 degrees to 135 degrees.

Trough portion 160 can include a plurality of trough orifices 162, shown here as disposed to one side of trough portion 160, but it is understood they can be disposed in a different arrangement as well as at other sections or locations within trough portion 160 or gutter lip attachment portion 190. In the embodiment shown here, the location and arrangement of the trough orifices 162 are such that the trough tread 164 can flex (in some small degree) so as to act as a spring board to help bounce leaves, pine needles and debris off the trough tread 164.

Trough riser or wall 166 connects to gutter lip attachment portion 190 at junction or corner 169. In some embodiments, the trough riser 166 may be less than ¼ the width the trough tread 164. In other embodiments, the trough riser 166 may be greater than ¼ the width the trough tread 164. It will be appreciated that the trough 160 and/or riser 166 may have a curved profile rather than an angular or flat profile. Gutter lip attachment portion 190 includes at least a lip tread 192. Lip tread 192 is configured to be fastenable to the gutter when the device 100 is in use. It will be appreciated that a variety of conventional fasteners may be utilized to fasten lip tread 192 to the gutter lip, such as but not limited to screws, rivets, double sided tape, etc. As stated above, trough portion 190 may be optional, being proxied with the last step of the step portion 130, which may have a last step configuration analogous or similar to the trough thread 164, but perhaps without a trough riser 166.

FIG. 3 shows a partial side view of the exemplary device 100, installed on a gutter G. The gutter G is attached to building B, having a roof R. The building B, the roof R and the gutter G are represented in this Fig. without great detail as any conventional elements of those items may be utilized and are only shown here to show application for the exemplary devices. It will be appreciated that the roof R can be any type of conventional roofing material, including asphalt shingles, tile roofing, etc. It will further be appreciated that the gutter G is configured to capture liquid, generally rainwater RW, that flows down the roof R and into the gutter G. The gutter G has a gutter lip GL. The exemplary device 100, when in use is disposed above the gutter opening GO. The device 100 is operably configured to span over the entire gutter opening GO. The device 100 extends from the roof R to the gutter lip GL. The device 100, along with other similar embodiments, will allow rainwater RW to pass from a top surface of the device 100 through the device 100 and into the gutter G, while preventing a substantial amount of debris from falling into the gutter G. Additionally, the device 100, along with other similar embodiments will enable nearly all of the rainwater RW to fall into the gutter G and not run over the gutter lip GL. The device 100 is shown in this Fig. is installed to the building B and gutter G with a near horizontal slope.

Mid-section of FIG. 3 shows a body of steps 130 including a first connecting step 136 joined to at least one middle step(s) 137 joined to a second connecting step 138. First connecting step 136 is disposed adjacent to roof attachment portion 110. Second connecting step 138 is disposed adjacent to trough portion 160. Second step 138 is closer in proximity to the gutter lip GL than the remaining steps 130. Second connecting step's 138 riser 150 is adjacent trough portion 160. The at least one middle step(s) 137 is shown in this example as having three inner steps. However, the number of inner steps can be varied as desired.

Each step of steps 130 has a step outside corner 154. Step outside corner 154 is formed by a top of a riser 152 of one step and an outside portion 153 of the tread of the adjacent step. As shown below, the step outside corners 154 may be formed at an acute angle causing one or more the respective treads and risers to be tilted or offset. Each step of steps 130 further includes a step inside corner 157. The step inside corner 157 is formed by a bottom 155 of a riser of one step and an inside portion 156 of the tread of the adjacent step. Orifices 134 are typically disposed proximal to the step inside corners 157. The step inside corners 157 may be formed at an acute angle causing one or more the respective risers and adjoining treads to be offset or tilted. That is, in some embodiments, step outside corners 154 may "extend" over and overhang past a neighboring step inside corner 157 under it (to form a Z-like shape, for example). Conversely, in other embodiments, the step corner angle(s) may be obtuse to cause step outside corners 154 to be slightly retarded or "short" so as to not overhand the neighboring step inside corner 157 under it.

Figure 4:
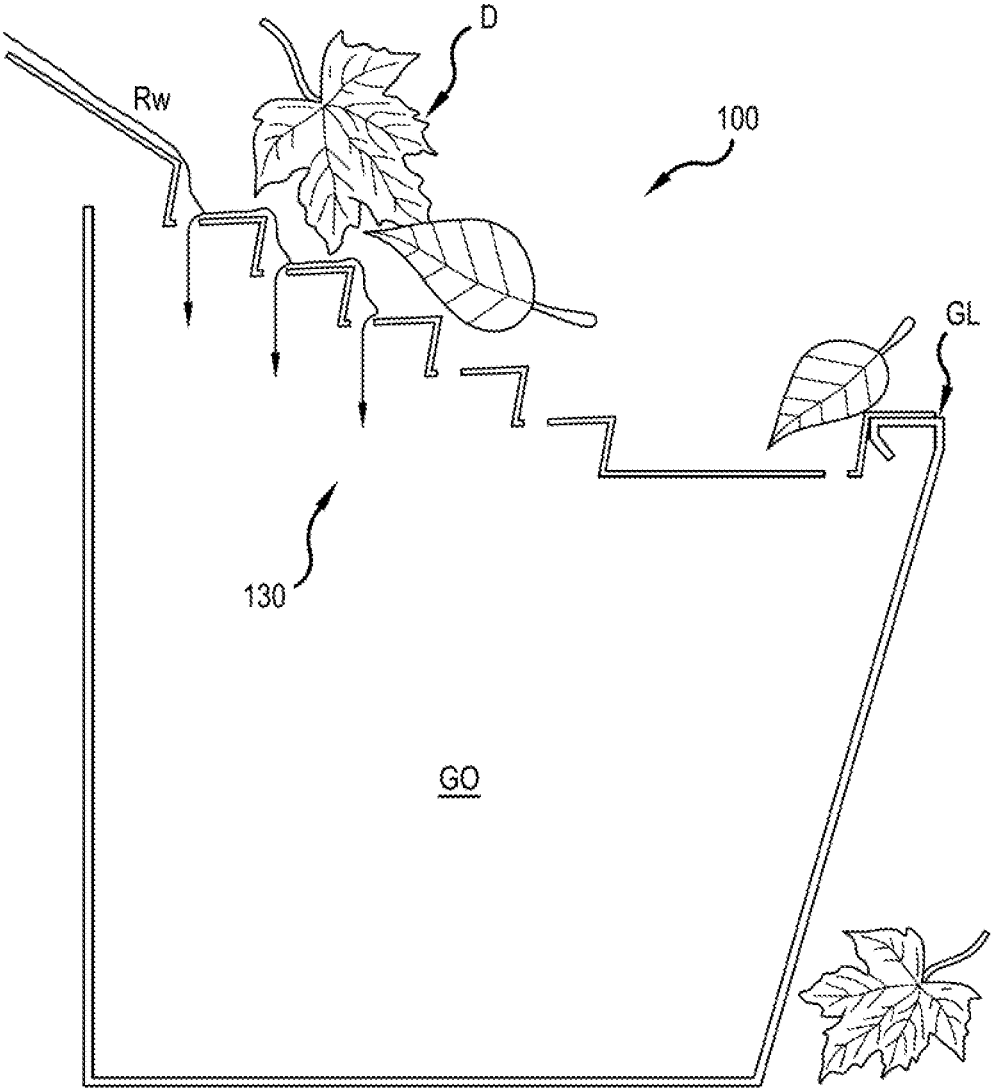
FIG. 4 is an illustration of an installed exemplary gutter guard with debris flowing over it.

FIG. 4 is an illustration of an installed exemplary device 100, with debris flowing over it. When the device 100 is in use, the downward arrangement of step portion 130 will cause rainwater RW to generally roll through the orifices within the steps and into the gutter opening GO. However, the shape and or angling of the step portion 130 will also generally enable leaves, pine needles and other debris D to simply skip down the steps toward the gutter lip GL. A majority of the rainwater RW from the roof will fall through the orifices in the step portion 120. Thus, less rainwater RW will arrive at the trough portion. Since rainwater falling off the gutter lip GL is not desirable, it is advantageous to have rainwater RW fall through the device 100 and into the gutter closer to the roof side rather than closer to the gutter lip GL.

Also of note is the lack of separate support structures in this design, wherein the device 100 is self-supporting due to the stepped nature and judicious placement of the orifices.

Figure 5:
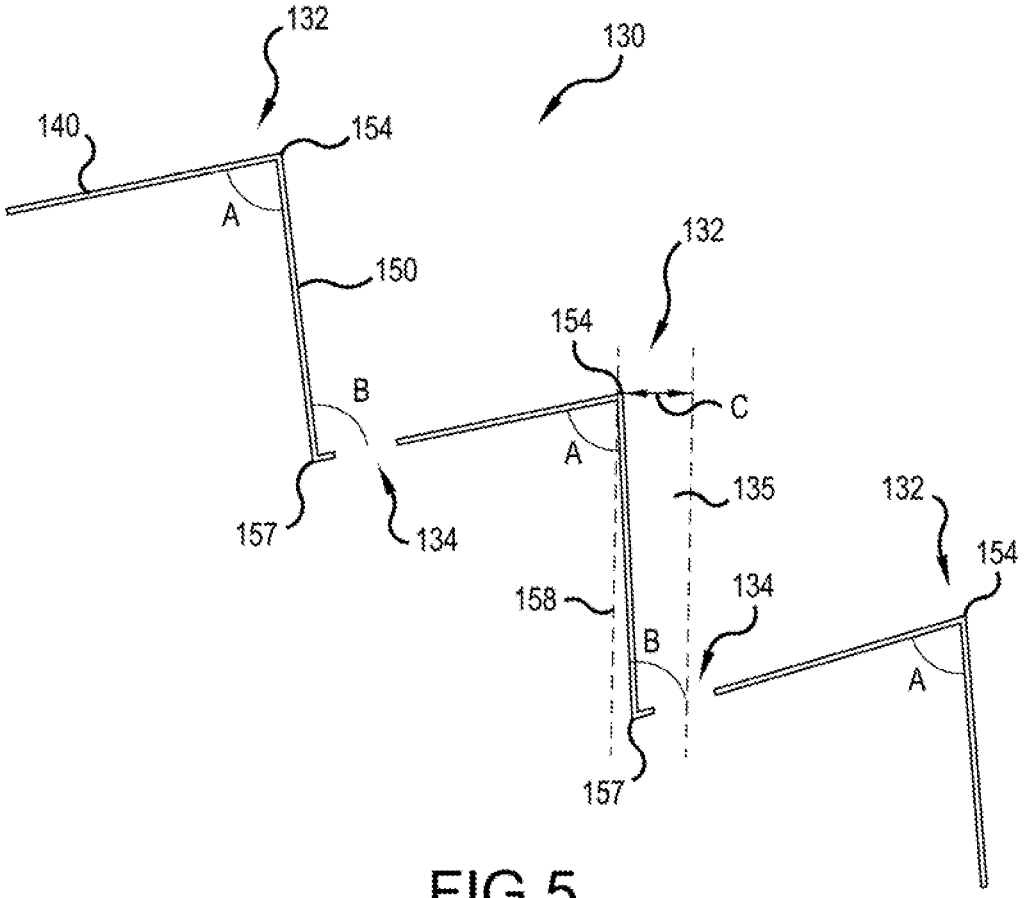
FIG. 5 is a close-up illustration of a section of the step portion for an exemplary single piece gutter guard.

FIG. 5 is a close-up illustration of a section of the step portion 130, for one possible embodiment, wherein three (of possibly less or more) steps 132 are shown. Each step 132 includes an angle A formed between riser 150 and tread 140. The step portion 130 also includes an angle B between adjacent steps. Angle B is formed between the tread 140 of one step and the riser 150 of the adjacent step. Angle A is the interior angle for the step outside corners 154. Angle B is the exterior angle for the step inside corners 157.

As illustrated in FIG. 5, angle A can be an angle 90 degrees or less, even down to 5 degrees, if so desired. In various experimental designs, angles of between 50-80 degrees were evaluated, as well as angles between 60 and 75 degrees. For the embodiment shown in FIG. 5, Angle A is set at approximately 87 degrees in perspective to tread 140 and riser 150.

Angle B can also be an angle 90 degrees or less, even down to 5 degrees, if so desired. In various experimental designs, angles of between 50-80 degrees were evaluated, as well as angles between 60 and 75 degrees. For the embodiment shown in FIG. 5, Angle B is set at approximately 87 degrees in perspective to tread 140 and riser 150.

Orifices 134 are shown as formed in the steps 132 along the step inside corners 157. With this arrangement, when the device 100 is in use on a gutter, the device 100 enables the outside corner 154 of one step to "protect" the orifices 134 formed in the adjacent lower step from debris falling directly into the lower step's orifice 134. This is possible because debris, traveling on the top of a tread 140, will usually have a given momentum from the water it is traveling on. This momentum will launch the debris or the debris will fall "forward" onto the lower next outside corner. See FIG. 4, for example. The width and tilt of the tread 140 will contribute to the effectiveness of debris transitioning off the device 100, as well as the height of riser 150 and overall slope of the step portion 130. For example, from experimental embodiments, it was found designs with tread lengths greater than riser heights tended to perform better with respect to water drainage and debris preclusion. In fact, improved results were found when the tread-to-riser ratio was at least 2:1.

The amount of "protection" afforded to the orifices 134 is based on the A & B angles, but also on a separation distance C between an orifice centerline 135 and vertical line 158 from the neighboring step outside corner 154. The separation distance C can be a positive value (e.g., orifice centerline 135 is displaced towards a gutter lip side of the device 100, further away from the vertical line 158), or can be a negative value (e.g., the orifice centerline 135 is displaced towards a roof side of the device 100 closer to the vertical line 158, or even past it). For the latter case, the step outside corner 154 will "overhang" the neighboring orifice 134. For experimental designs, using a device 100 sized to cover a 5 inch wide gutter, with a run-to-rise ratio of 2, it was found that a value of C approximately 0.166 inches (with 0.25 inch variability) was well suited for debris removal, while providing a high water drainage result.

Figure 6:
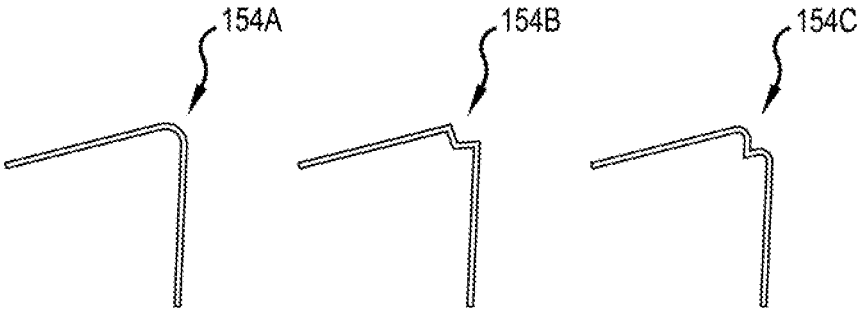
FIG. 6 is an illustration of alternative step outside corners for an exemplary single piece gutter guard.

FIG. 6 is an illustration of sample alternative step outside corners. For example, the first image shows a rounded corner 154A. The second image shows a micro-stepped corner 154B. And the third image shows a rounded-micro-stepped corner 154C. These illustrations are provided to show that the outside corner does not need to have a defined edge but can be smooth or blunt or other shaped. For example, the edge can be chamfered or any variation of a shape thereof.

Figure 7A:
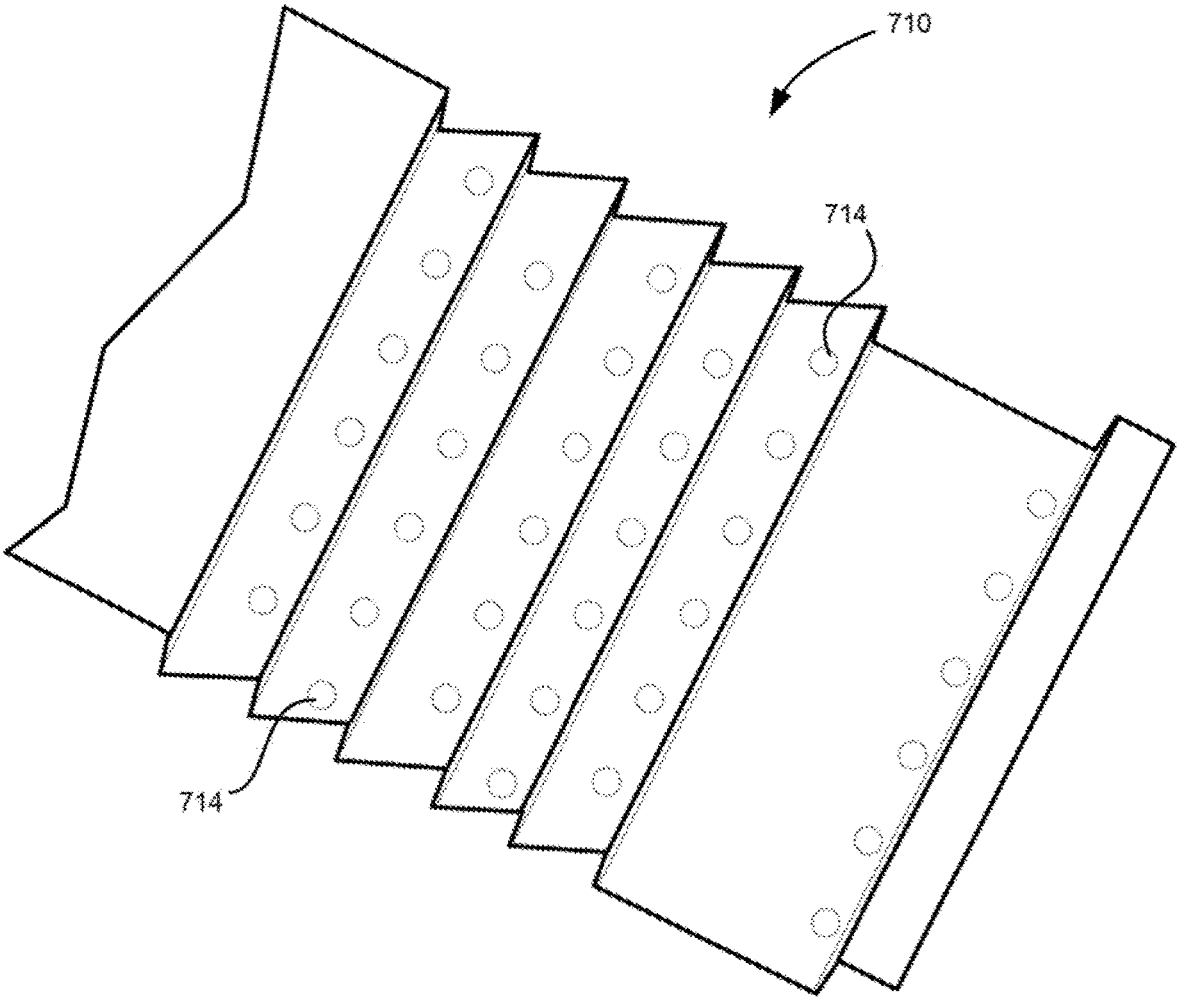
FIG. 7A is an illustration of an exemplary gutter guard with a variation of the tread orifice location.

As stated above, the various orifices may be disposed at other locations in the exemplary device. For example, FIG. 7A is an illustration of an exemplary embodiment 710, wherein the tread orifices 714 are disposed closer to a gutter lip side end of the respective tread.

Figure 7B:
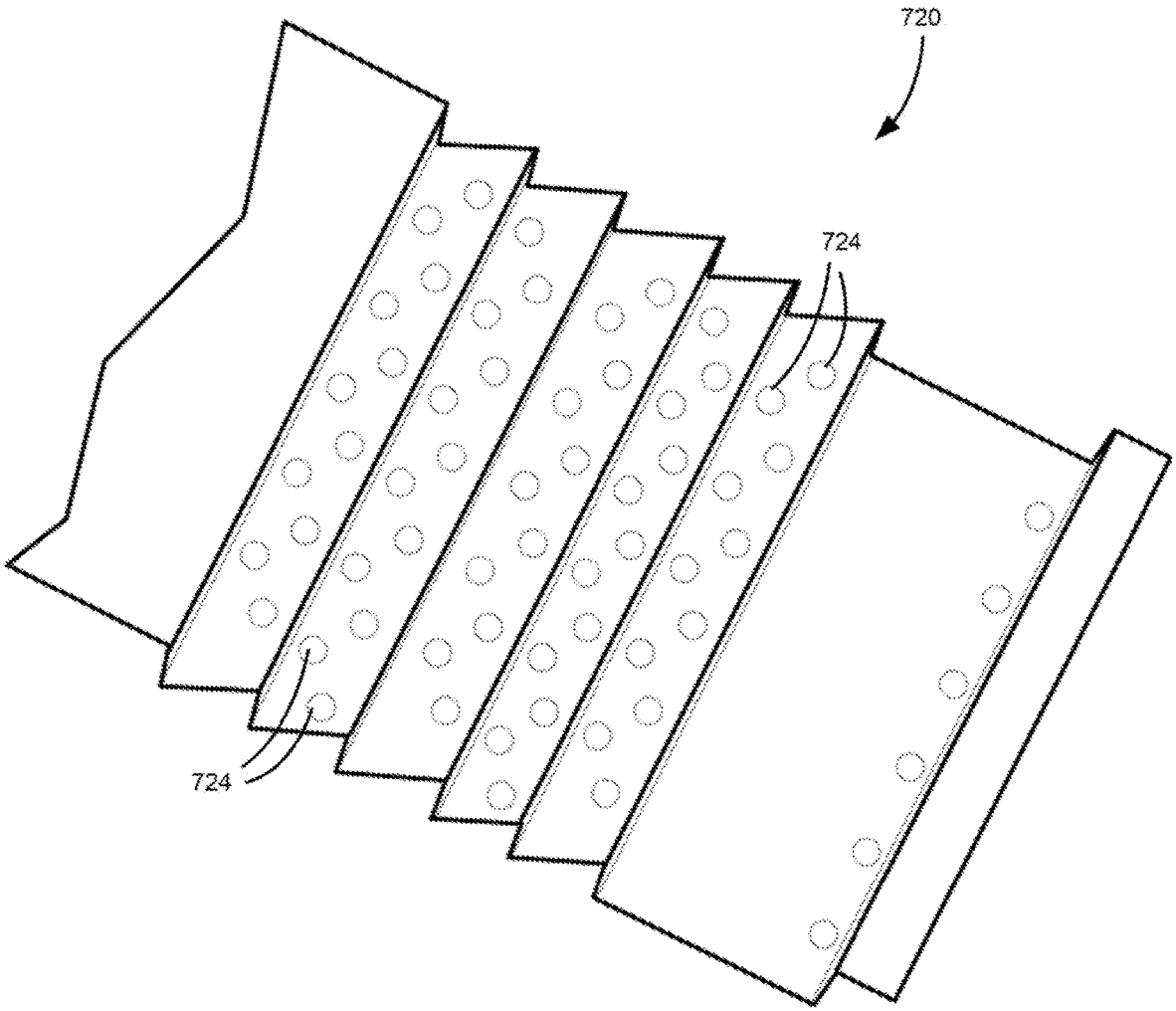
FIG. 7B is an illustration of an exemplary gutter guard with staggered rows of tread orifices.

FIG. 7B is an illustration of an exemplary embodiment 720, wherein the tread orifices 724 are arranged as two staggered rows on the step treads.

Figure 7C:
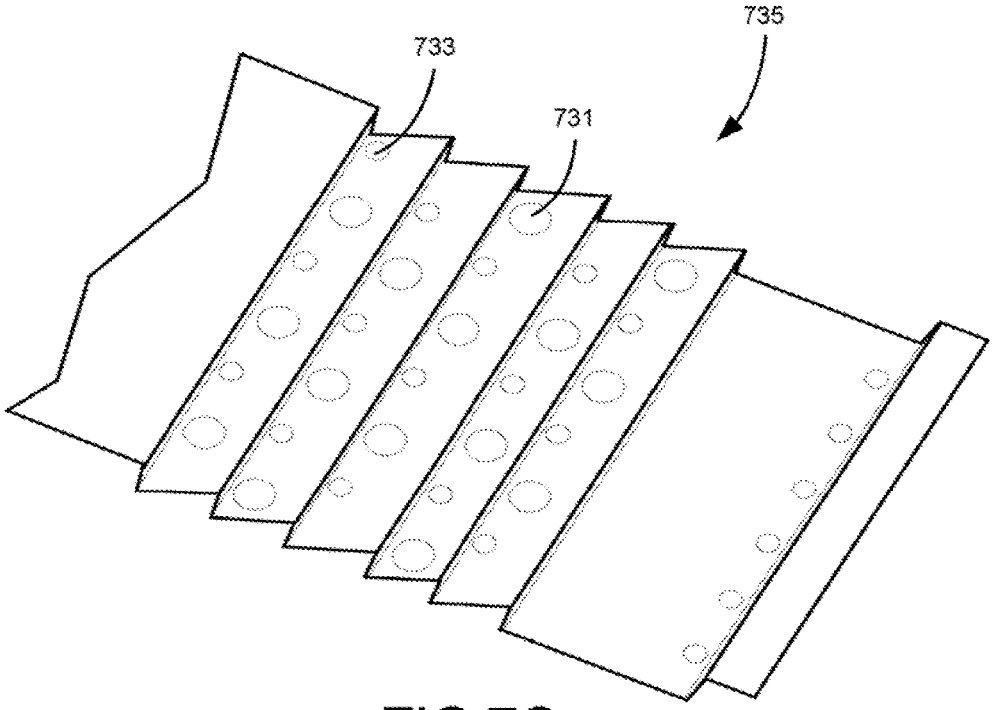
FIG. 7C is an illustration of an exemplary gutter guard, wherein the tread orifices are of different sizes.

FIG. 7C is an illustration of an exemplary embodiment 730, wherein the tread orifices are of different diameters or sizes 731, 733. It should be appreciated that the respective shapes may be different than shown.

Figure 7D:
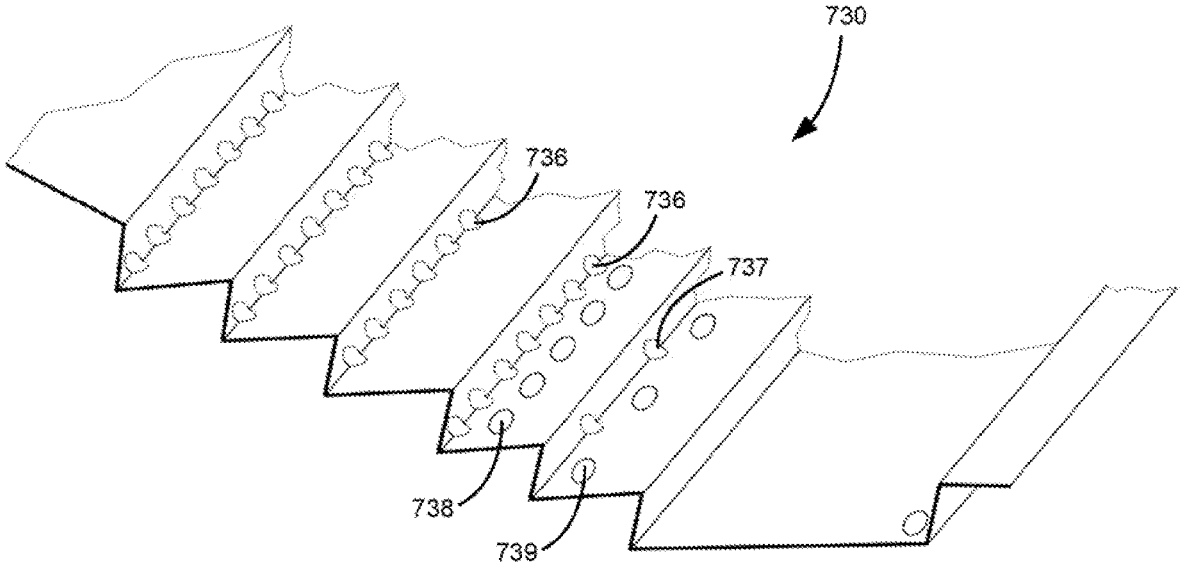
FIG. 7D is an illustration of an exemplary gutter guard, wherein the tread orifices are shared at the riser-tread junction and reduced orifices.

FIG. 7D is an illustration of an exemplary embodiment 735, wherein the tread orifices are shared with the riser (disposed at the riser-tread junction) 736. Additionally, the reduction in number and increase in spacing is seen in riser-tread orifice 737. Similarly, tread orifices 738 and 739 show a reduction in number and increase in spacing.

Figure 7E:
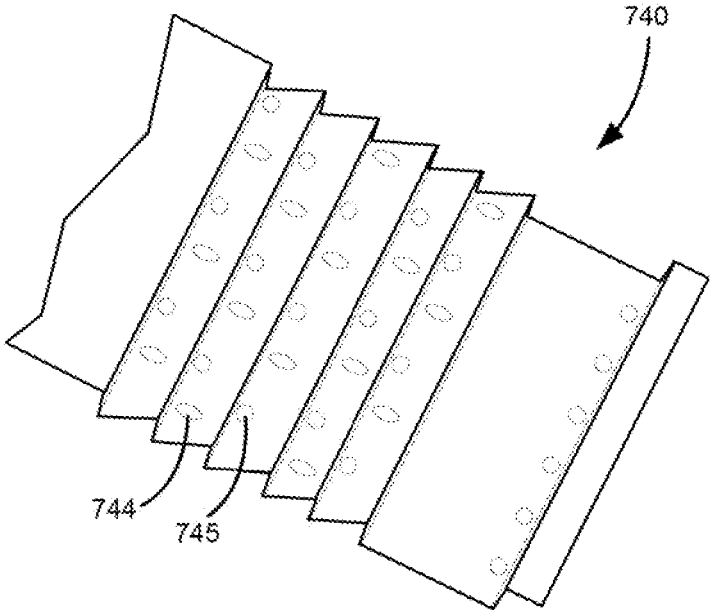
FIG. 7E is an illustration of an exemplary gutter guard, wherein the tread orifices are of different shapes.

FIG. 7E is an illustration of an exemplary embodiment 740, wherein the tread orifices are of different shapes 744, 745.

Figure 7F:
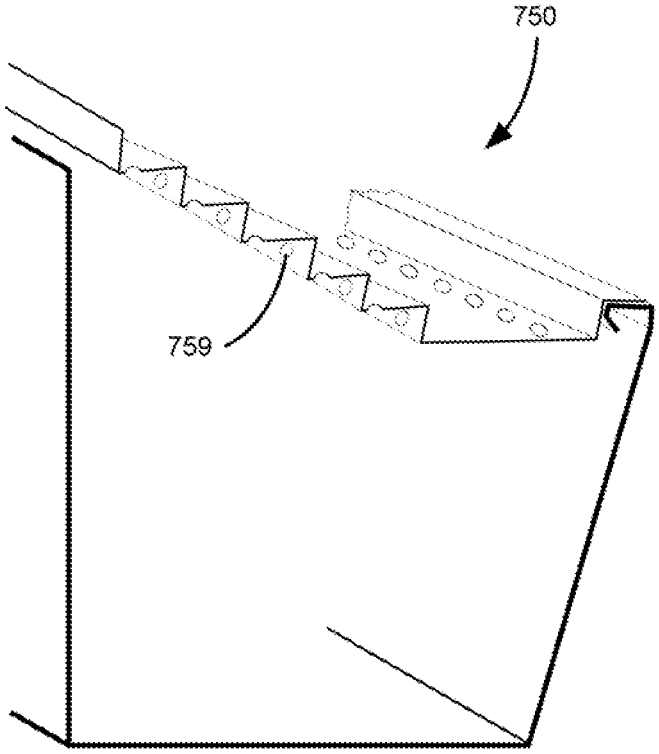
FIG. 7F is a perspective view of an installed exemplary gutter guard, wherein the orifices are also disposed in the risers.

FIG. 7F is a perspective view of an installed exemplary embodiment 750, wherein the orifices 759 are also disposed in the risers.

Figure 8A:
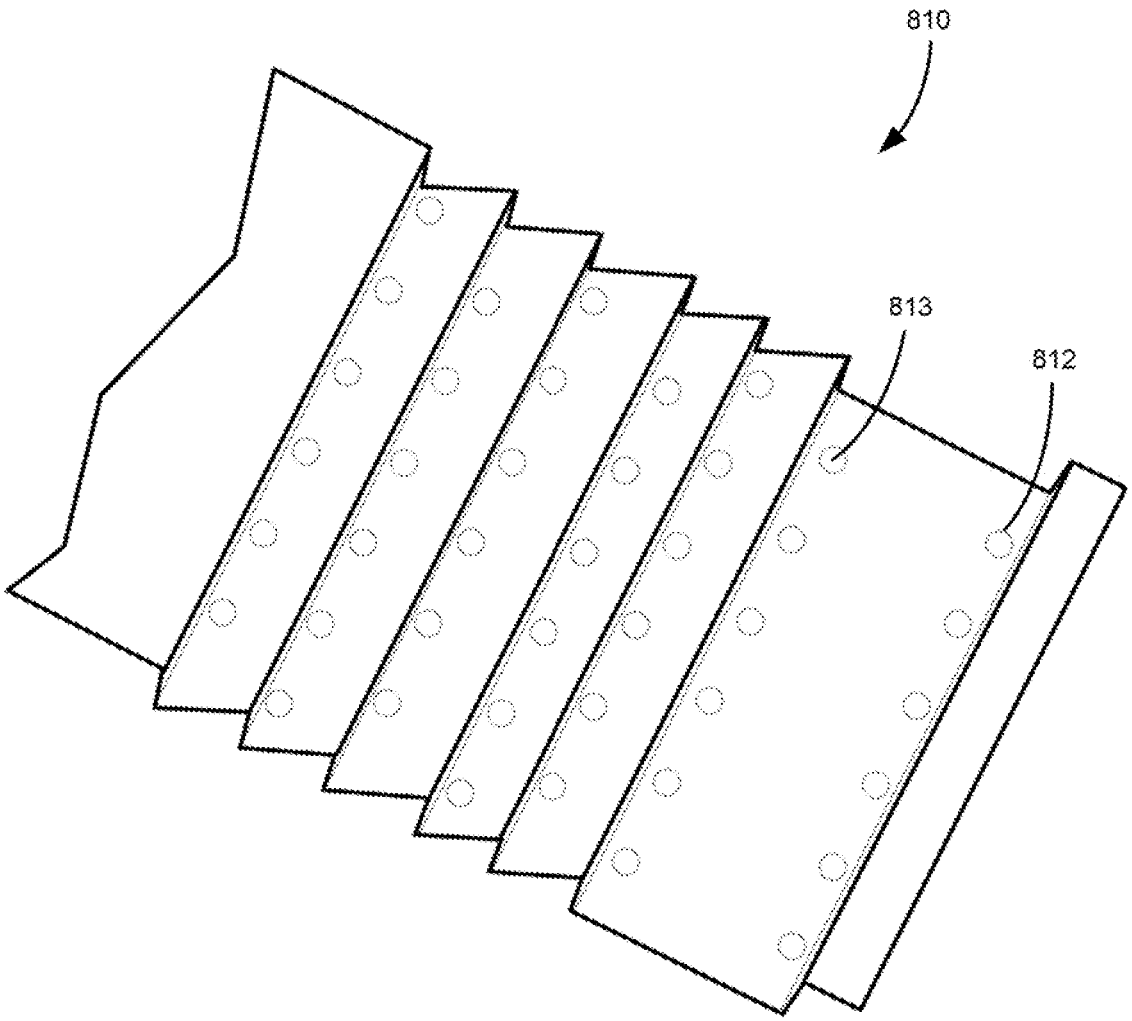
FIG. 8A is an illustration of an exemplary gutter guard with an additional "row" of trough orifices.

FIG. 8A is an illustration of an exemplary embodiment 810, wherein an additional "row" of trough orifices 813 is positioned on an opposite side of the trough from gutter lip side trough orifices 812.

It should be appreciated that the various exemplary embodiments shown here demonstrate orifices disposed in each tread, wherein the presences of the orifices improve the water drainage factor of the "orificed" treads on the gutter guard. However, it is understood that in some embodiments, one or more treads may not be orificed, or if they are present, the orifices may be limited in amount. Therefore, one or more embodiments are possible where alternating treads, or a sequence of treads, or combination of alternating sequence of treads, for example, may be orificeless, understanding this can be a design choice.

Figure 8B:
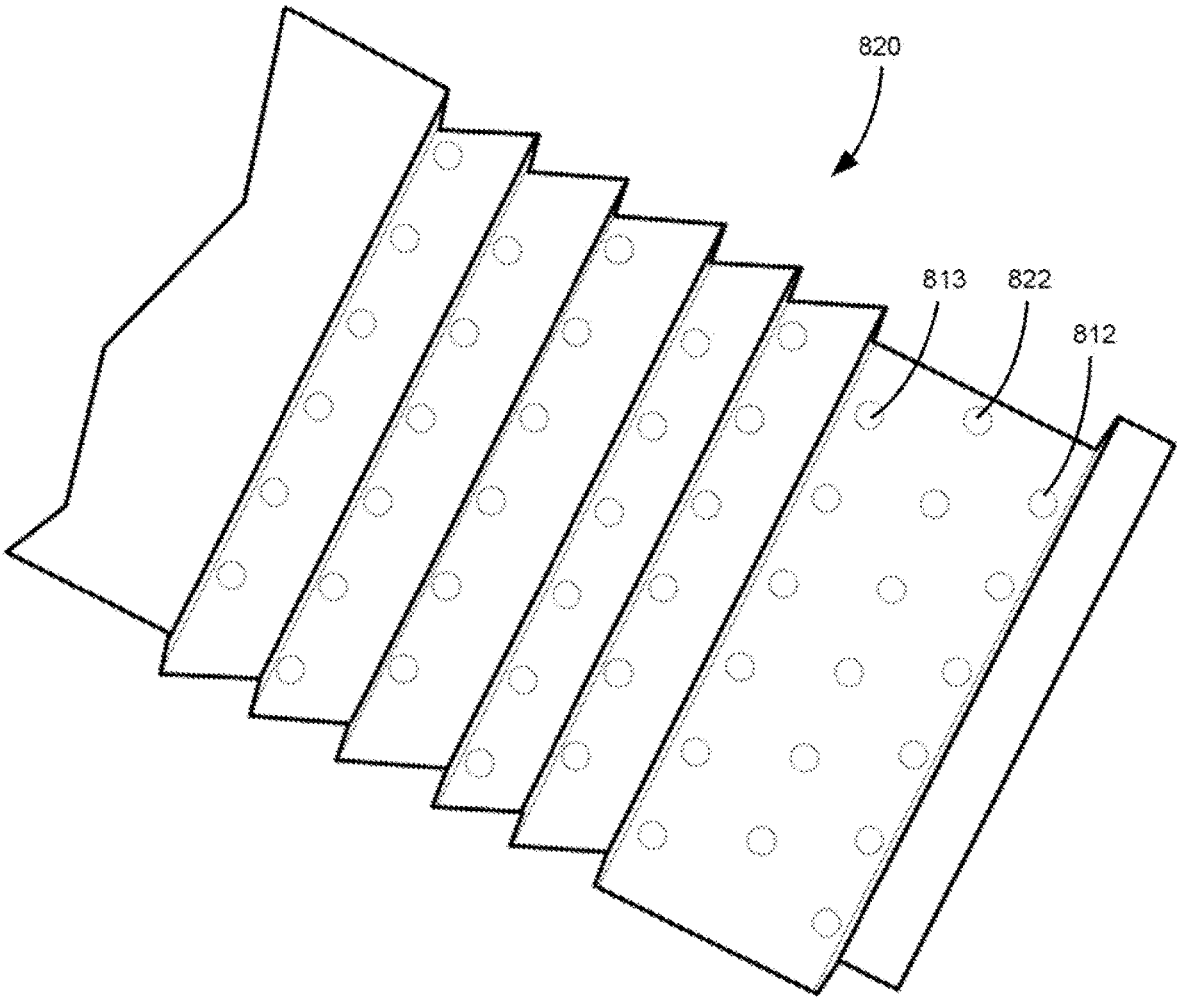
FIG. 8B is an illustration of an exemplary gutter guard with another "row" trough orifices.

FIG. 8B is an illustration of an exemplary embodiment 820, wherein another "row" of trough orifices 822 is positioned between the trough orifices 812 and 813 shown in FIG. 8A.

Figure 9A:
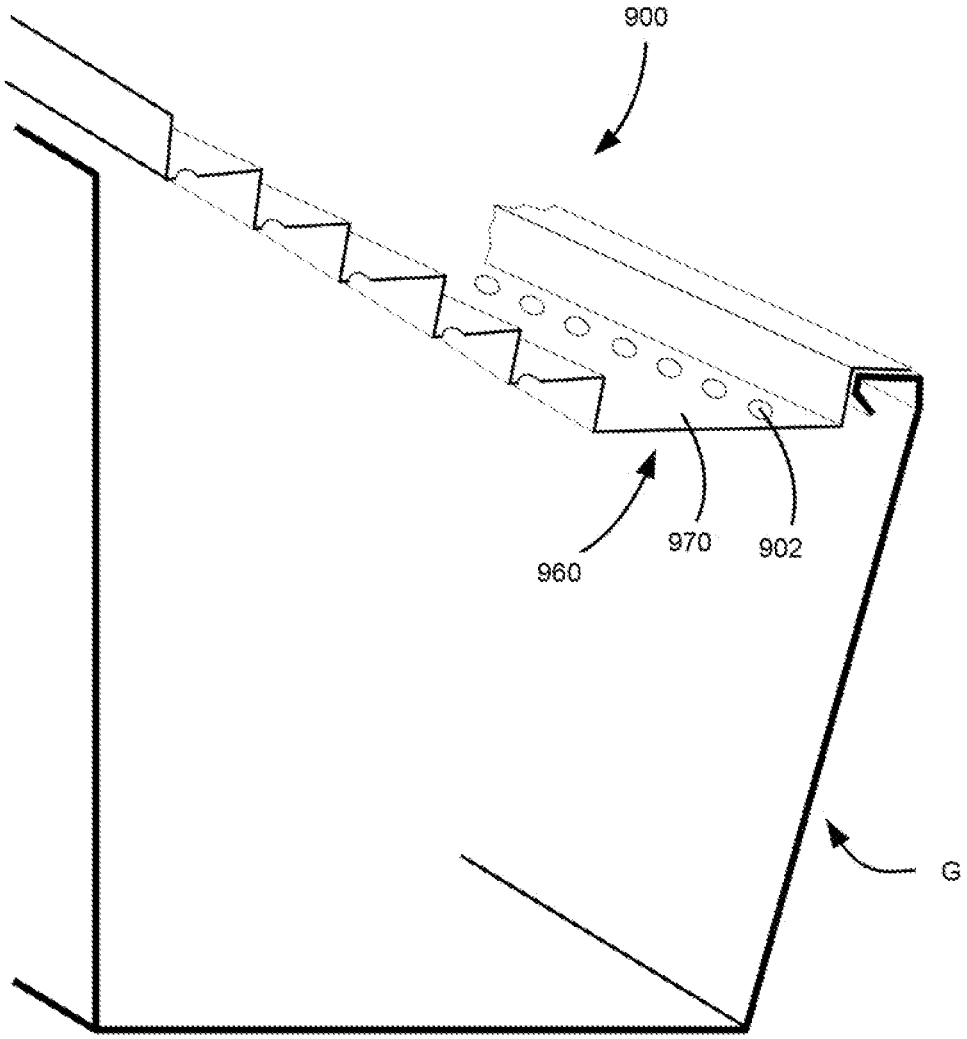
FIG. 9A is a perspective view of an installed exemplary gutter guard with trough orifices.

FIG. 9A is a perspective view of an installed exemplary embodiment 900, showing a set of trough orifices 902 disposed in the floor 970 of trough portion 960.

Figure 9B:
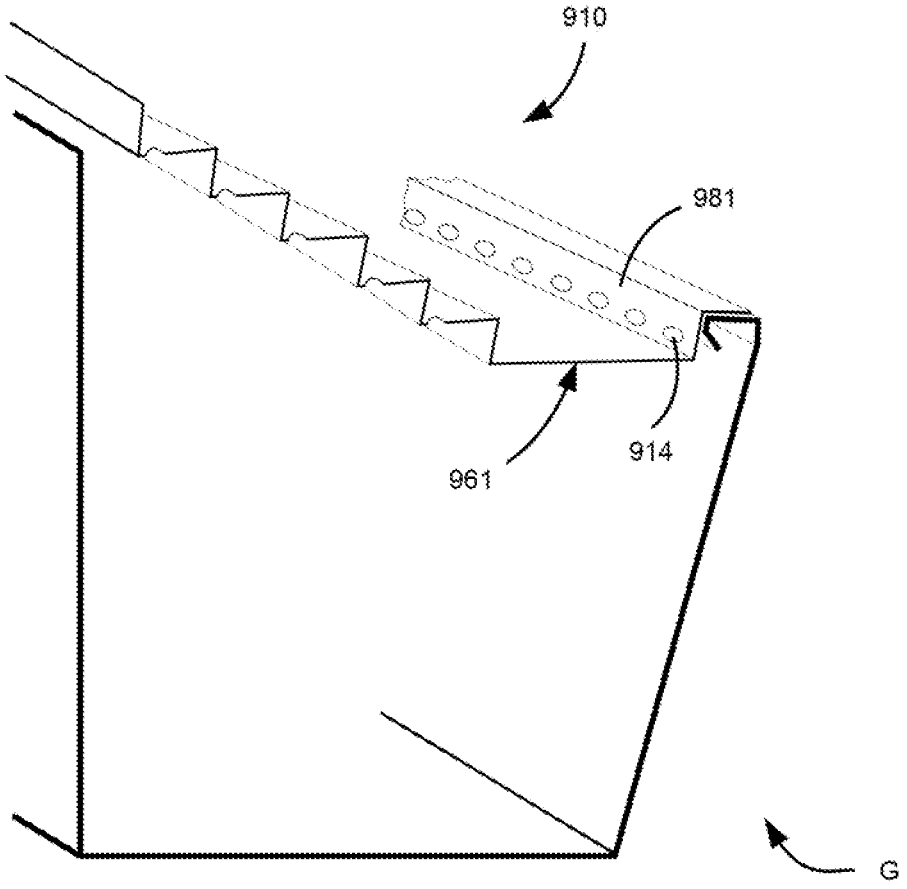
FIG. 9B is a perspective view of an installed exemplary gutter guard with laterally disposed trough orifices.

FIG. 9B is a perspective view of an installed exemplary embodiment 910, showing trough orifices 914 laterally disposed in the gutter lip side riser or wall 981 of the trough portion 961. This embodiment shows these trough orifices 914 as the only orifices in the trough portion 961. It should be appreciated that side wall trough orifices 914, in this and other embodiments, may be disposed at any height, orientation, arrangement, etc. within the side wall of the trough portion. However, locations nearer to the floor of the trough portion are understood to provide earlier and more effective drainage.

Figure 9C:
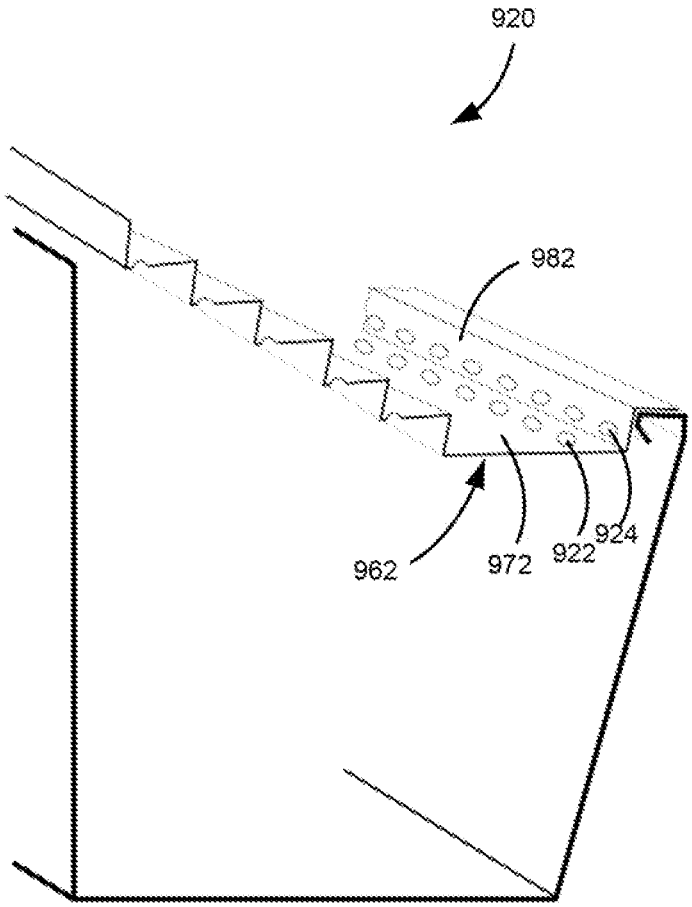
FIG. 9C is a perspective view of an installed exemplary gutter guard with floor and laterally disposed trough orifices.

FIG. 9C is a perspective view of an installed exemplary embodiment 920, showing laterally disposed trough orifices 924 in side wall 982 of the trough portion 961, as well as trough orifices 922 in the floor 972 of the trough portion 962.

Figure 9D:
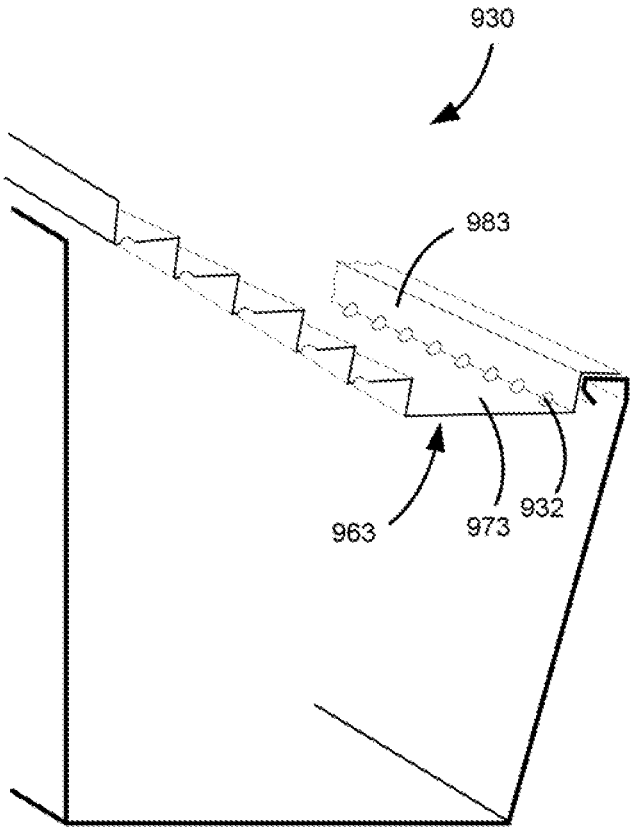
FIG. 9D is a perspective view of an installed exemplary gutter guard with corner disposed trough orifices.

FIG. 9D is a perspective view of an installed exemplary embodiment 930, showing trough orifices 932 disposed in the corner formed by floor 973 and side wall 983 of the trough portion 963.

Figure 9E:
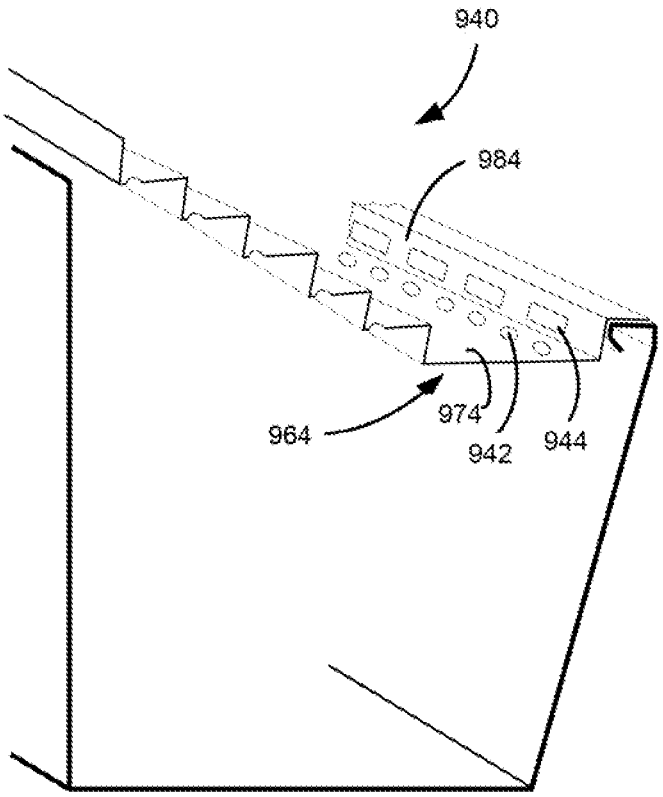
FIG. 9E is a perspective view of an installed exemplary gutter guard with laterally disposed rectangular trough orifices and floor orifices.

FIG. 9E is a perspective view of an installed exemplary embodiment 940, showing laterally disposed trough orifices 944 having a rectangular "window" shape inside wall 984 and orifices 942 in floor 974 of the trough portion 964.

Figure 9F:
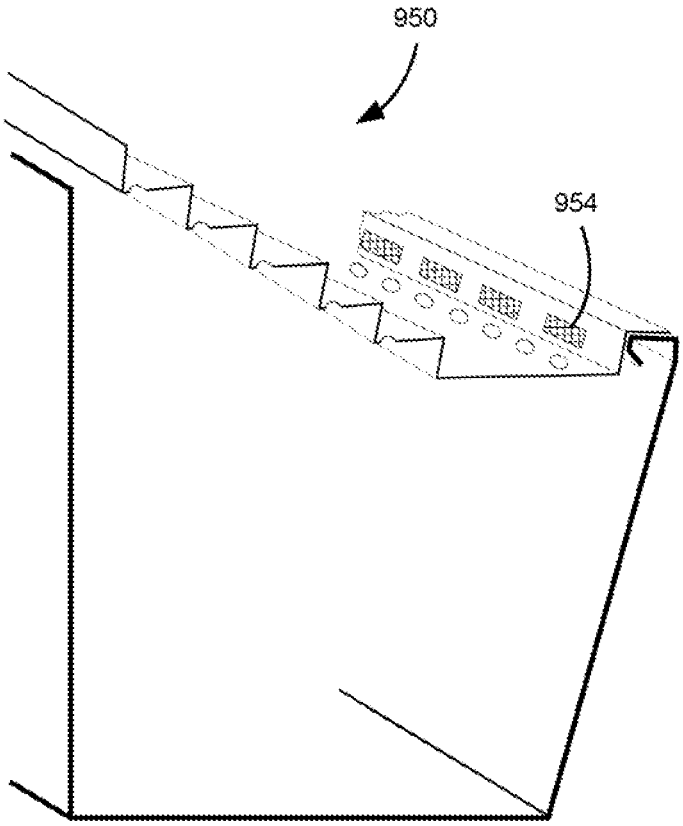
FIG. 9F is a perspective view of a modification of the embodiment of FIG. 9E, with screened orifices.

FIG. 9F is a perspective view of a modification of the embodiment of FIG. 9E, wherein the windows 954 are screened to prevent debris entrance.

It should be appreciated that the above illustrations show a trough width that is significantly greater than a neighboring step width. However, in some embodiments, the trough width may be equivalent to or less than a width of the neighboring step width, this being a design variable. Nonetheless, for various experimental designs, the trough width was tested at a width of approximately 1 inch for a 5 inch gutter spanning gutter guard.

As should be apparent, the above Figs. illustrate only a small set of various possible modifications to the embodiment shown in FIG. 2. Therefore, it is understood that the above examples are not to limit the breath of the possible embodiments, and that other changes and modifications may be made without departing from the spirit and scope of this disclosure.

Figure 10:
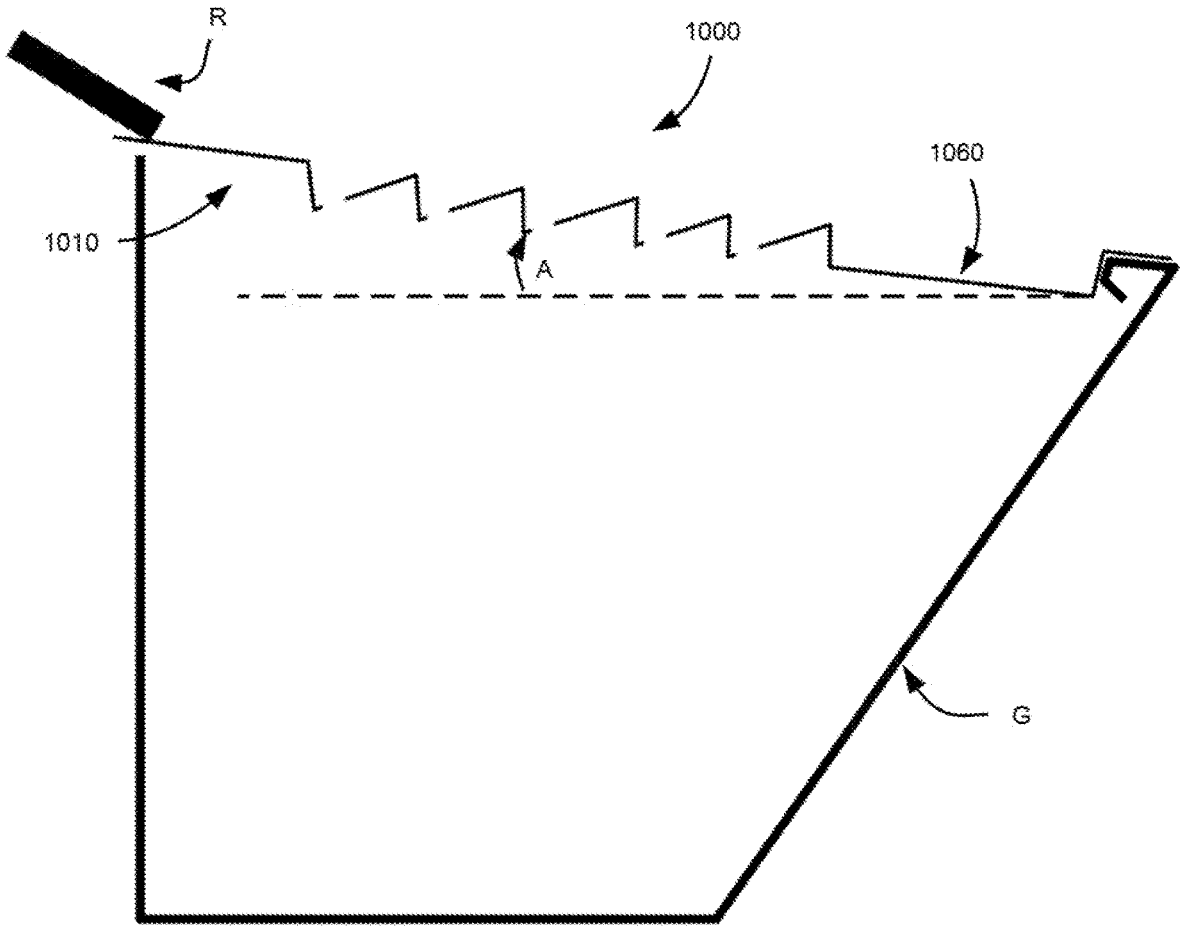
FIG. 10 is a side view illustration of an installed exemplary gutter guard at a shallow installation angle.

FIG. 10 is a side view illustration of an exemplary embodiment 1000 installed over a gutter G. It is noted here that the "installation" slope A of the device 1000 is very shallow, being the roof attachment portion 1010 is disposed under the roof R.

Figure 11:
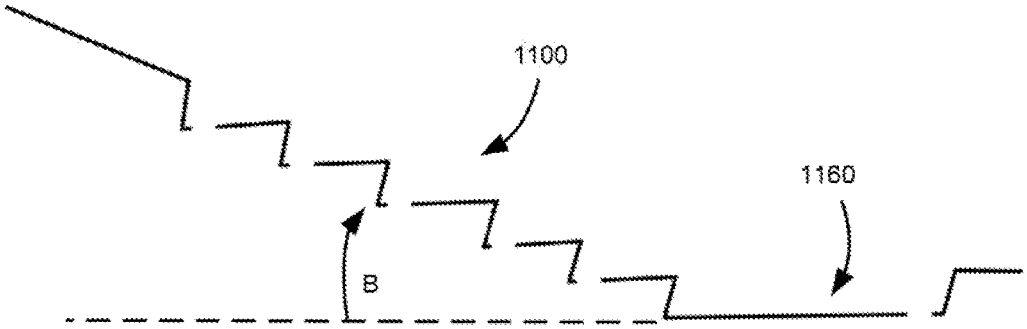
FIG. 11 is a side view illustration of an exemplary gutter guard at a larger installation angle.

FIG. 11 is a side view illustration of an exemplary embodiment 1100 with a larger "installation" slope B.

Figure 12:
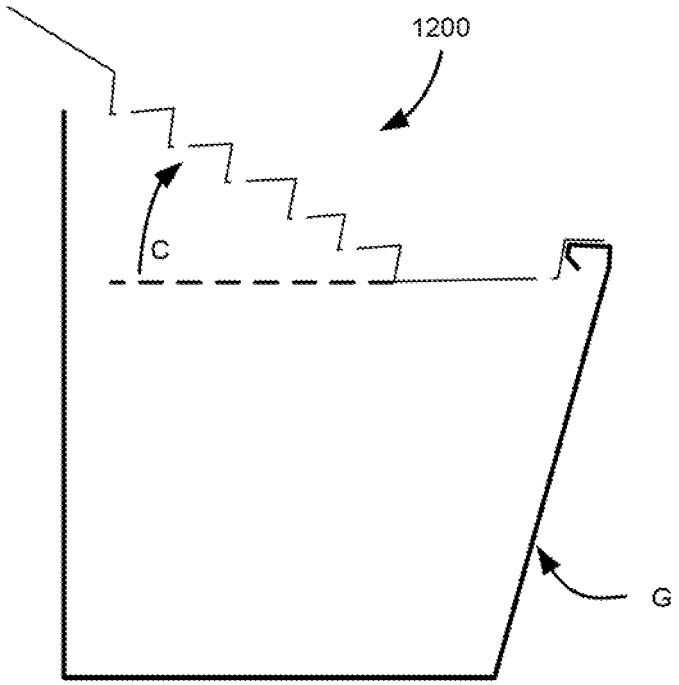
FIG. 12 is a side view illustration of an installed exemplary gutter guard at a greater installation angle.

FIG. 12 is a side view illustration of an exemplary embodiment 1200 installed over a gutter G, wherein the "installation" slope C is greater than the slopes shown in FIGS. 10 and 11.

The embodiments of FIGS. 10, 11, and 12 are the same device, however, positioned at different angles of installation. These Figs. illustrate the ability of the exemplary device to be installed at different angles while still preserving its gutter guard characteristics. Of particular note is that the exemplary device may flex to accommodate different angles, as well as different size gutters, wherein the flexing does not significantly affect the overall characteristics of the device.

The design of the exemplary gutter guard allows it to fit on practically any size and type of gutter. An installer can easily modify or adjust the overall depth (from the perspective of the front of gutter to back of gutter) so it will fit whatever gutter desired to be installed on. The exemplary gutter guard also has inherent qualities that allows it to be flexible as well as fit snuggly over the gutter.

Figure 13A:
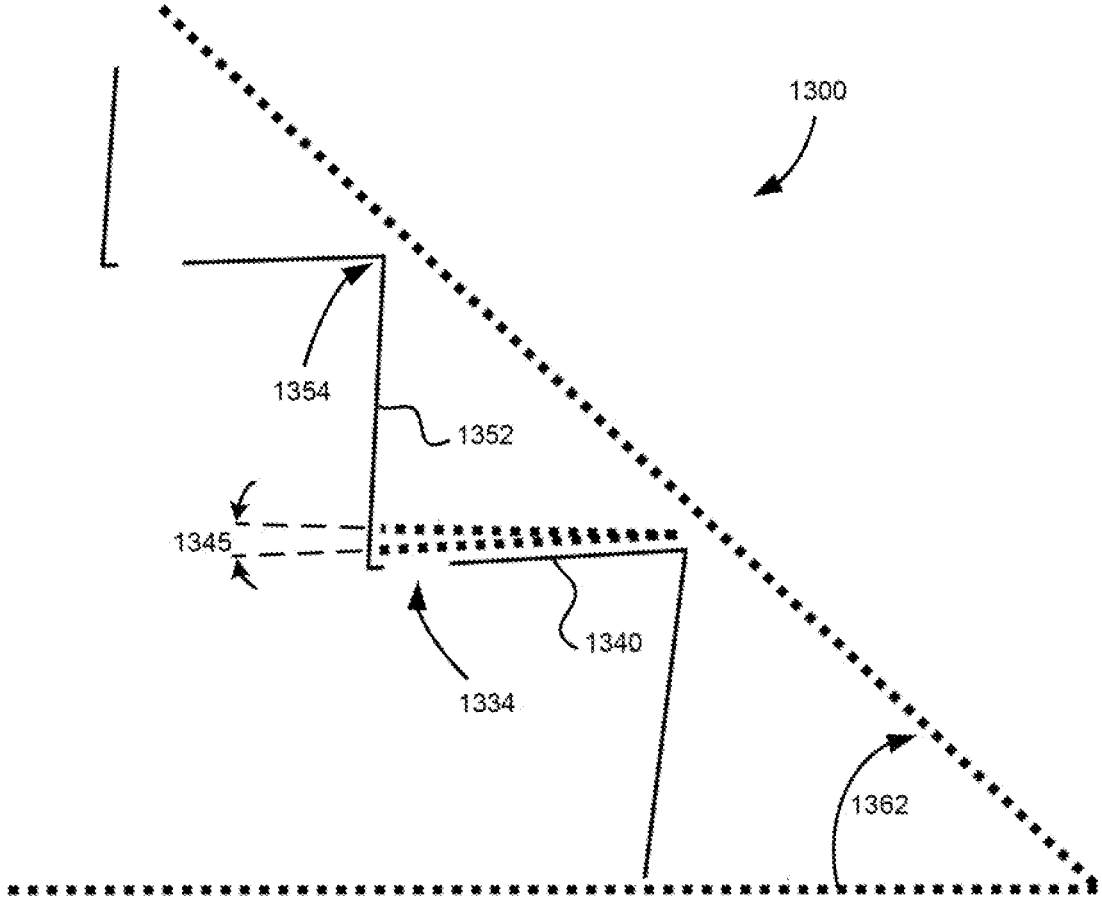
FIG. 13A is an exploded side view of a step portion of an exemplary gutter guard, with an installation slope angle of approximately 45 degrees.

FIG. 13A is an exploded side view of a step portion 1300 of an exemplary device, having an installation slope angle 1362 of approximately 45 degrees Step outside corner 1354 protrudes over and covers a portion of the lower orifice 1334 disposed adjacent to the step outside corner's riser 1352. With such an overhang acting to shield the orifices 1334, the orifices 1334 can be larger than with a non-overhang design. With larger orifices 1334, a greater volume of rainwater can be directed into the gutter.

The step's treads 1340 can be reverse sloped (tilted back) by a tilt angle 1345 of approximately 10 degrees down from the horizon, given the approximate 45 degree installation angle. This arrangement elevates the outside corners to cause rainwater to be forced back towards the orifices, and with several orifice steps, it is unlikely rainwater will ever reach the gutter lip. Because the combination of steps act like stairs, debris will progressively fall "down" onto the next step. The greater the tilt angle 1345, the more water will be drained in the earlier steps of the step portion 1300.

Therefore, it will be appreciated that the exemplary devices enable rainwater to more readily flow into the gutter at the roof side end of the device, thus reducing the possibility of rainwater falling off the gutter lip side. Additionally, because there is a natural slope in the stair-step design, exemplary embodiments will be highly effective at allowing debris to move across and fall off the gutter.

Figure 13B:
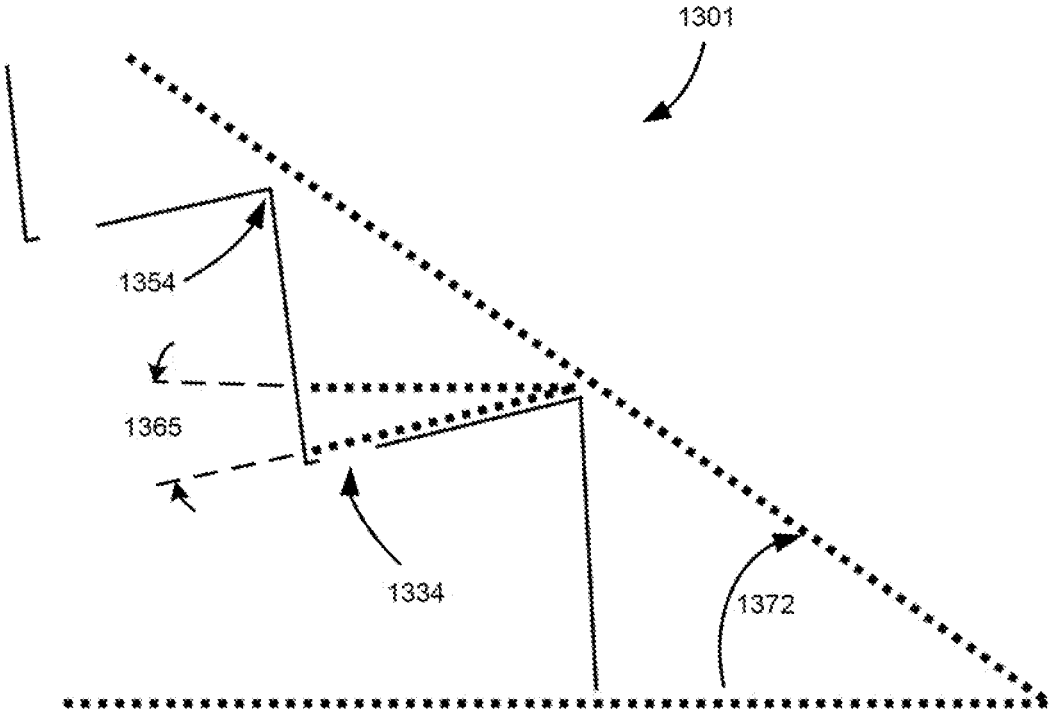
FIG. 13B is an exploded side view of a step portion of an exemplary gutter guard, with an installation slope angle of approximately 35 degrees.

FIG. 13B is an exploded side view of a step portion 1301 of an exemplary device, having an installation slope angle 1372 of approximately 35 degrees. Therefore, the treads' tilt angle 1365 (approximately 15 degrees) is shown to be greater than the tilt angle 1345 (approximately 5 degrees) of FIG. 13A. In this configuration, step outside corner 1354 is displaced away from step 1334, not providing an overhang. The higher tilt angle 1365 will promote a greater amount of water to drain through the orifice 1334.

Figure 13C:
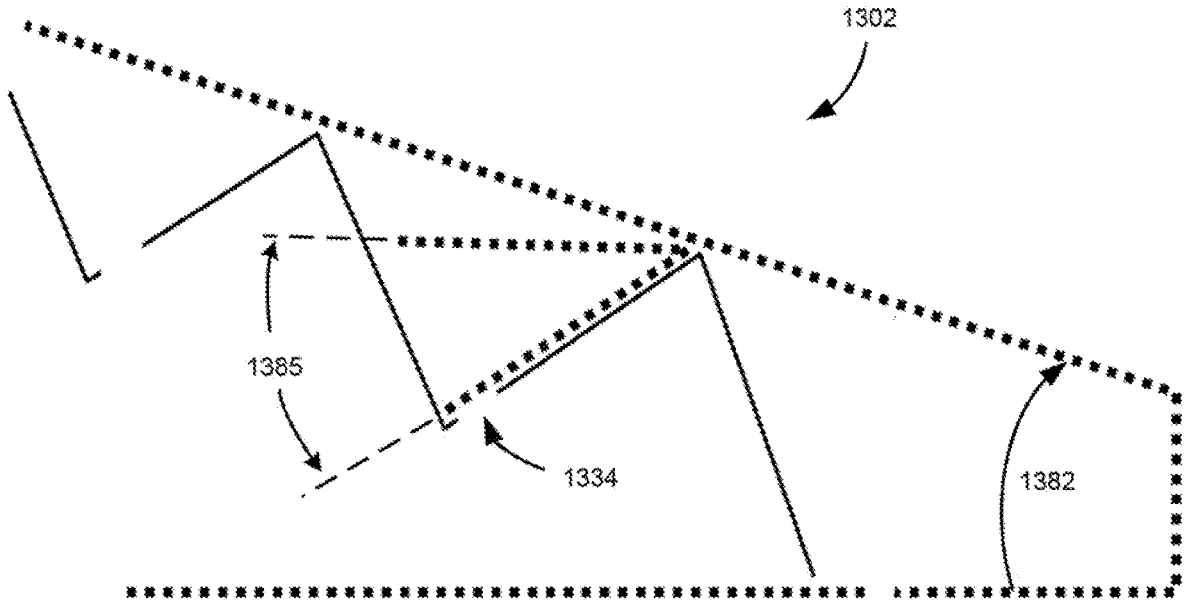
FIG. 13C is an exploded side view of a step portion of an exemplary gutter guard, with an installation slope angle of approximately 15 degrees.

FIG. 13C is an exploded side view of a step portion 1302 of an exemplary device, having an installation slope angle 1382 of approximately 15 degrees. Therefore, the treads' tilt angle 1385 is shown to be greater than the tilt angle 1365 of FIG. 13B, and for this example is approximately 15 degrees.

It should be appreciated from the above Figs. that the installation slope can vary. However, it is believed the exemplary gutter guard can function very well between installation angles of approximately 20-53 degrees, wherein it is believed 35 degrees or thereabouts provides an ideal slope. Of course, depending on the steepness of the roof, amount of trees near gutters, approximate distance of trees to the gutters, the type of tree, high or low rainfall regions, height of gutter above the ground (for example, if the gutter is on the 2nd or 3rd story, there is less chance of debris issues falling on the gutter guard), and other factors, different "optimal" angles may be found.

FIGS. 13A-C illustrate the relationship between the angles of the stair-step backward sloped ledges (e.g., treads) and the overall slope of the stair-steps, for a fixed tread-riser length ratio and fixed corner angle(s). Steeper sloped stair-step ledges improve water penetration into the gutter, because the tilted ledges act as barriers to inhibit rainwater flow from traveling past the ledge. Therefore, steeper sloped stair-step ledges help ensure higher volumes of rainwater will go down the orifices in the ledges. In many ways, they act as micro-troughs.

A compromise, however, is that the orifices are more exposed to debris (since there is less of an overhang protecting them). To address this, smaller holes can be devised. Or the outside corners can be positioned to overhang or be closer to the inside corners by appropriate adjustment of the respective A & B corner angles (FIG. 5) as well as the riser heights and/or the tread widths. That is, the apparent L-like shape of the stairs may be shifted to be more Z-like, for a different gutter installation slope angle, or vice versus. Thus, in light of the above, it is understood that various modifications and changes to the designs being shown are within the spirit and scope of this disclosure.

Figure 14A:
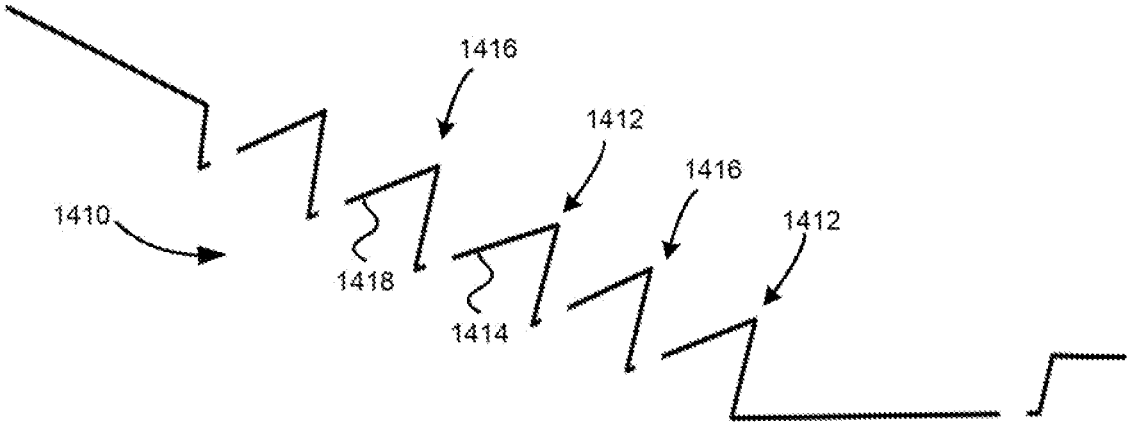
FIG. 14A is an illustration of an exemplary gutter guard with steps having varying lengths.

FIGS. 14A-H are side view illustrations demonstrating various exemplary embodiments with differing step shapes, orientation, and sizes. For example, FIG. 14A shows an embodiment 1410 with steps 1412 with longer treads 1414 than for the treads 1418 of steps 1416. A slight shifting of the steps can be seen in the step pattern.

Figure 14B:
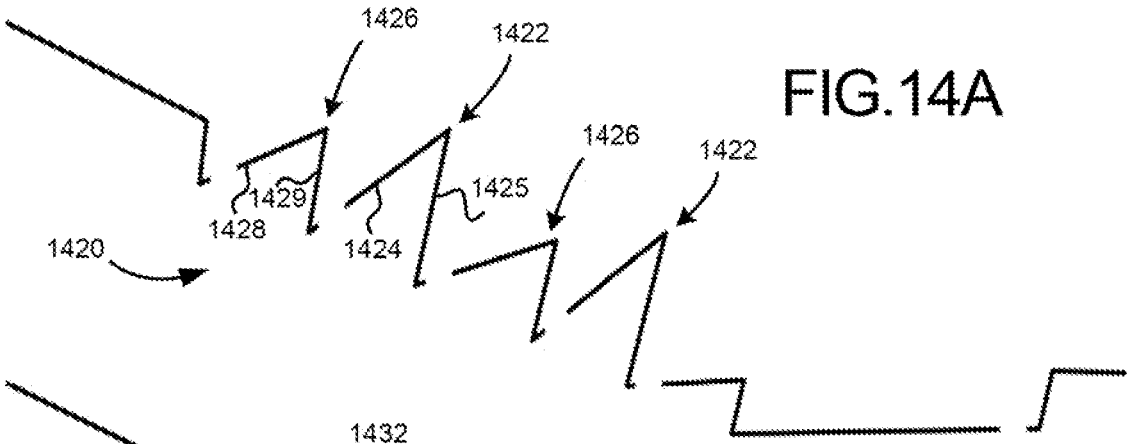
FIG. 14B is an illustration of another exemplary gutter guard with steps having varying lengths.

FIG. 14B shows an embodiment 1420 with steps 1422 with longer treads 1424 and risers 1425 than the treads 1428 and risers 1429 of steps 1426. The obvious result is steps 1422 protrude significantly more than steps 1426. As is apparent, water entering into steps 1422 is more likely to be impeded from flowing out of the steps 1422 than for steps 1426.

Figure 14C:
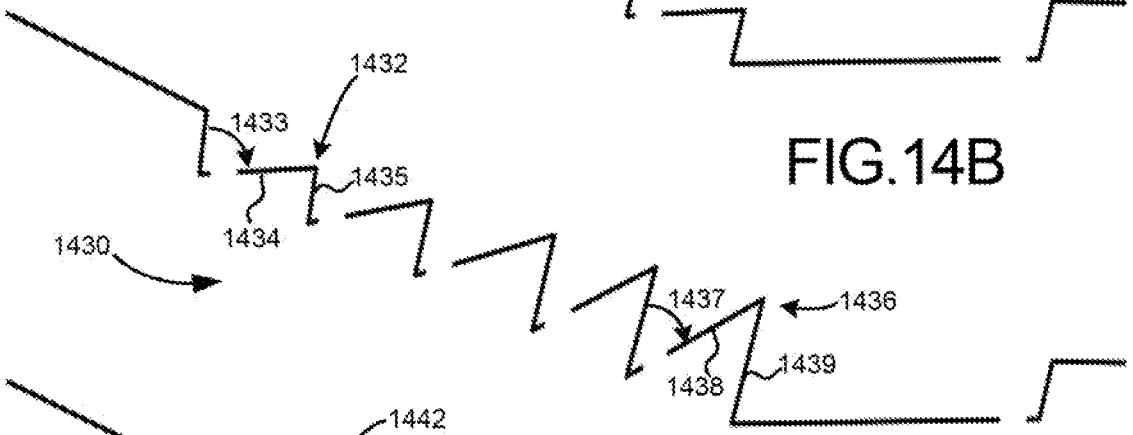
FIG. 14C is an illustration of another exemplary gutter guard with steps having varying lengths.

FIG. 14C shows an embodiment 1430 with increasing riser lengths (or equivalently, increasing tread lengths). This results in steps gradually changing shape and increasing in size with accompanying reduction in angles. For example, first step 1432 has a first angle 1433 with first tread 1434 and first riser 1435. Last step 1436 has a last angle 1347 with last tread 1438 and last riser 1439. The reduction between the first and last angles, as well as the increase in the riser lengths (and accompanying tread lengths to match) is self-evident.

Figure 14D:
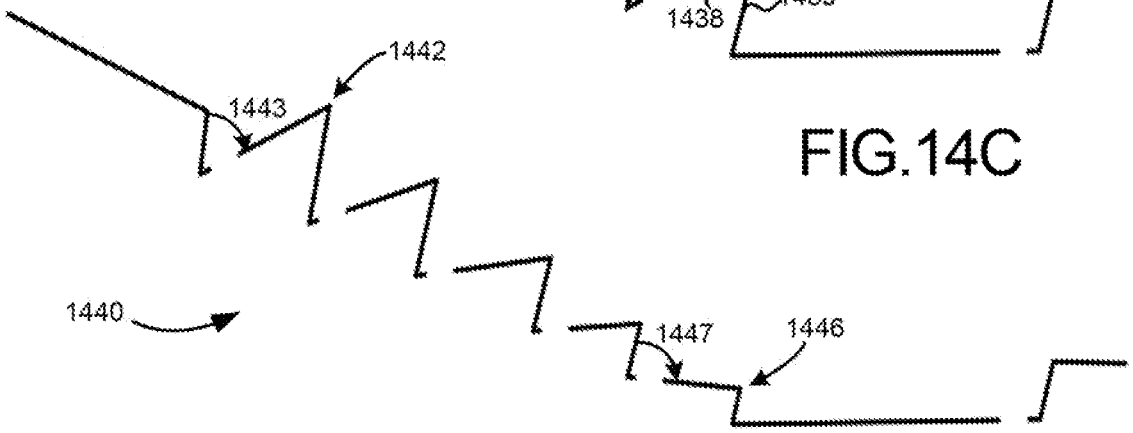
FIG. 14D is an illustration of another exemplary gutter guard with steps having varying lengths.

FIG. 14D shows an embodiment 1440 that is the reverse of FIG. 14C, with deceasing riser lengths (or equivalently, increasing tread lengths). This results in steps gradually changing shape and decreasing in size and with accompanying increase in angles. For example, first step 1442 has a first angle 1433 and last step 1446 has a greater last angle 1447. The increase between the first and last angles, and attendant change in the step shape and size is self-evident.

Figure 14E:
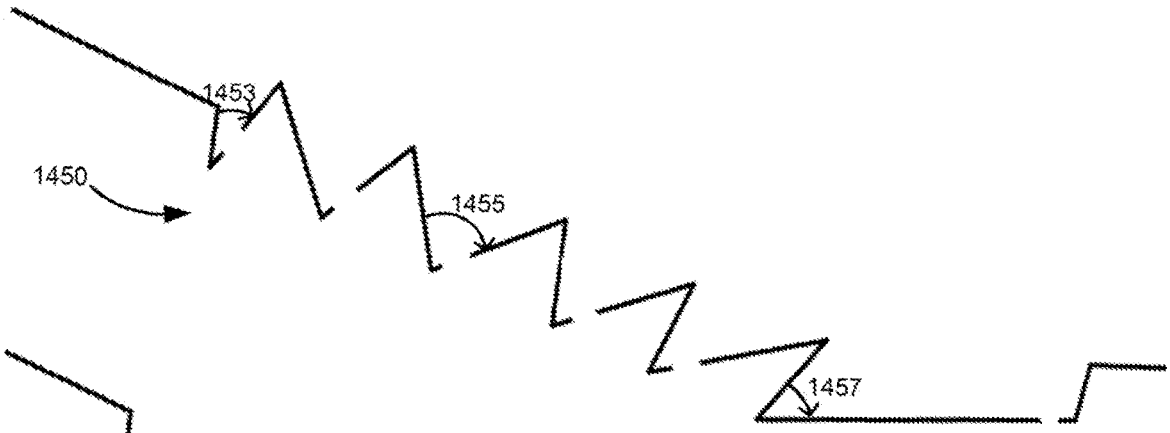
FIG. 14E is an illustration of an exemplary gutter guard with steps having varying angles.

FIG. 14E shows an embodiment 1450 with angle increases and reduction between the steps. First angle 1453 is smaller than angle 1455 which in turn is larger than angle 1457. The up-down change in the angles results in the shapes and orientations of the steps to change. Accordingly, step angles and attendant shapes, orientations, sizes may be varied according to design preference.

Figure 14F:
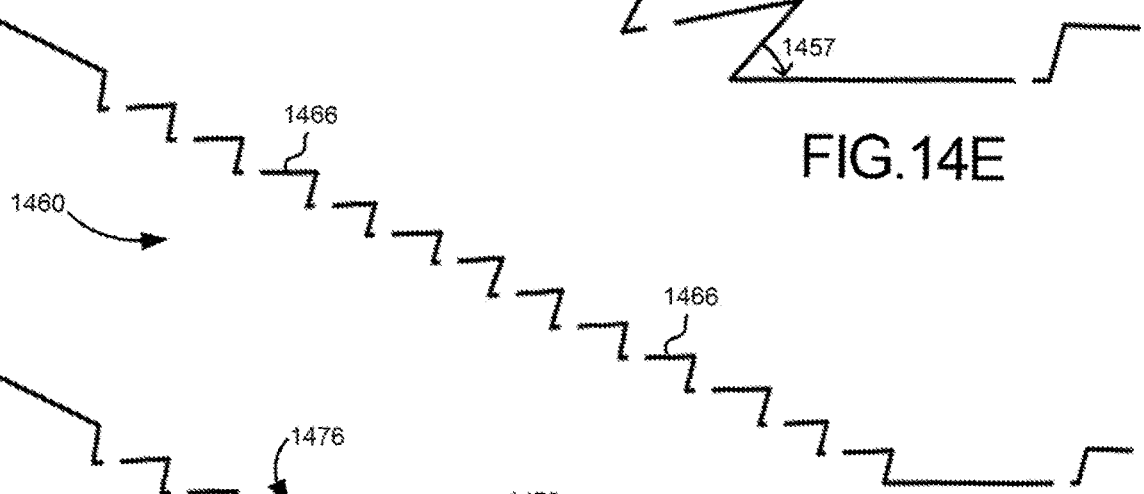
FIG. 14F is an illustration of an exemplary gutter guard with small step sizes.

FIG. 14F shows an embodiment 1460 with constant angle steps 1466 with smaller tread/riser lengths than in the previous embodiments. This results in a high number of steps per unit length along the device.

Figure 14G:
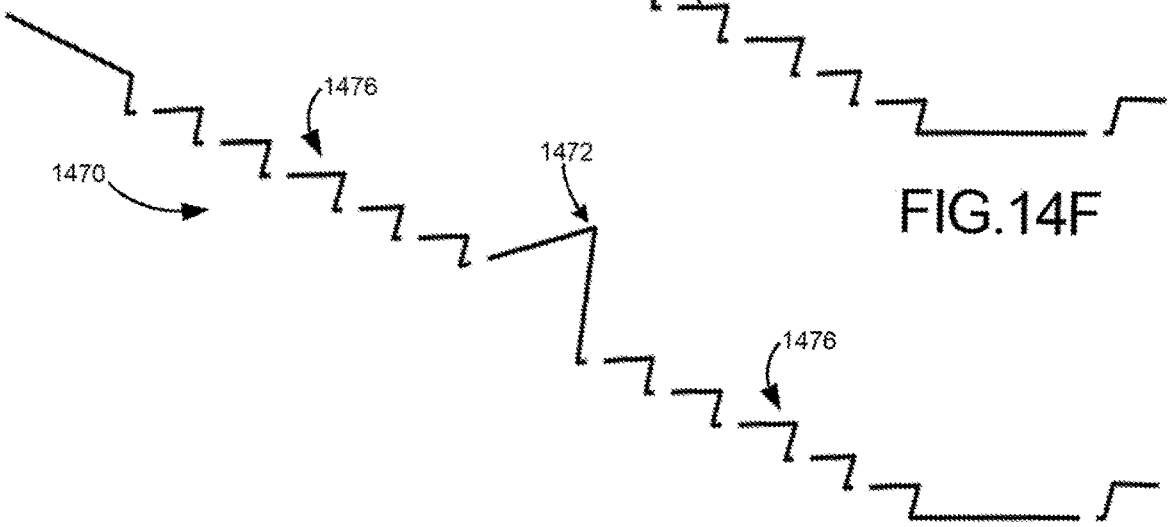
FIG. 14G is an illustration of an exemplary gutter guard with an embedded enlarged step.

FIG. 14G shows an embodiment 1470 with the uniform steps 1476 but with a singular enlarged step 1472. While this Fig. shows the enlarged step 1472 in the "middle" of the step progression, the enlarged step 1472 may be in any other part of the progression. Similarly, a converse embodiment can be envisioned, with a "smaller" step embedded among larger steps.

Figure 14H:
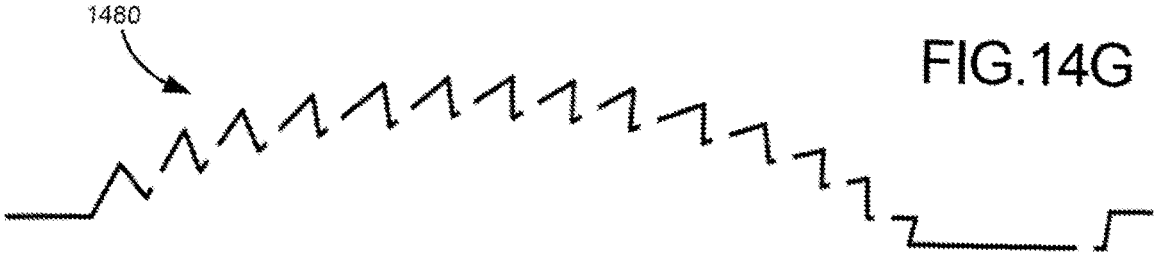
FIG. 14H is an illustration of an exemplary gutter guard with an arched configuration.

FIG. 14H shows an embodiment 1480 similar to the embodiment shown in FIG. 14F, but arched to fit a near zero installation angle. This configuration illustrates the ability of the exemplary device to "fit" undersized gutters (by arching the device) or gutters where the installation angle is substantially horizontal.

For designs where a single piece gutter guard is desired, it will be appreciated that there needs to be a balance between the rigidity of the guard to allow it to span the gutter, and having enough holes, perforations, and/orifices so that water will fall through the guard and into the gutter. The balancing act is that as one increases the number of holes and thus the cumulative hole area in the gutter guard, the guard will decrease in rigidity. The reduced rigidity means a supporting structure is often needed or the underlying guard material must be of a higher stiffness or weight which typically increases the costs. Further, the increase in overall hole area will also increase the likelihood that debris can get caught as the debris engages the guard. Therefore, a design that provides a large enough hole area without sacrificing rigidity would be significant.

In view of the above, a design using an exemplary stair-stepped embodiment spanning a 5 inch wide gutter was tested having about 120 holes per 1 foot long section. Each hole had a diameter of about 0.18 inches to result in a cumulative hole area of 3.224 square inches per foot long section of the exemplary device. By way of comparison, a conventional one-piece gutter guard, which is commonly available as Smart Screen and has about 288 holes per foot length, and has a total hole area of about 5.29 square inches. It should be noted here that increased hole count does not necessarily translate to increased water penetration. In fact, it may be the opposite. For example, the increase in hole count is usually obtained by reducing the hole size, which results in reducing the ability for the water to penetrate the gutter guard.

Another conventional one-piece gutter guard commonly available as Leaftek, has a hole count of 320 per foot length and a total hole area of about 5.8 square inches. Amerimax Titan (an Ominmax company) is another conventional one-piece gutter guard, having a 432 hole count per foot length, and a hole area of about 7.6 square inches. The Leaftek and Amerimax Titan have both larger hole count and larger hole area. The former factor was discussed above, the latter factor is that with excessively large hole areas, the more likely debris will enter into the hole. Therefore, an engineering tradeoff is necessary, wherein hole size, area, and ability to capture water while minimizing debris entrance is sought.

An exemplary design with a lower hole area per foot length was tested and a performance comparison of the above exemplary design and the above conventional gutter guards revealed that the exemplary design performed significantly better with respect to water capture while having less hole area (meaning less debris is likely to enter the gutter). Thus, the exemplary design can be intrinsically stiffer, whereby thinner, less expensive materials can be used for a given span, or longer spans can be covered, while retaining superior performance over conventional gutter guards.

Because of the protection from the step overhang, less holes, but larger diameter holes can be used. In one exemplary embodiment, the diameter of the holes was about 21% larger than the prior art's but had an increase in water flow by over 400%.

Figure 15:
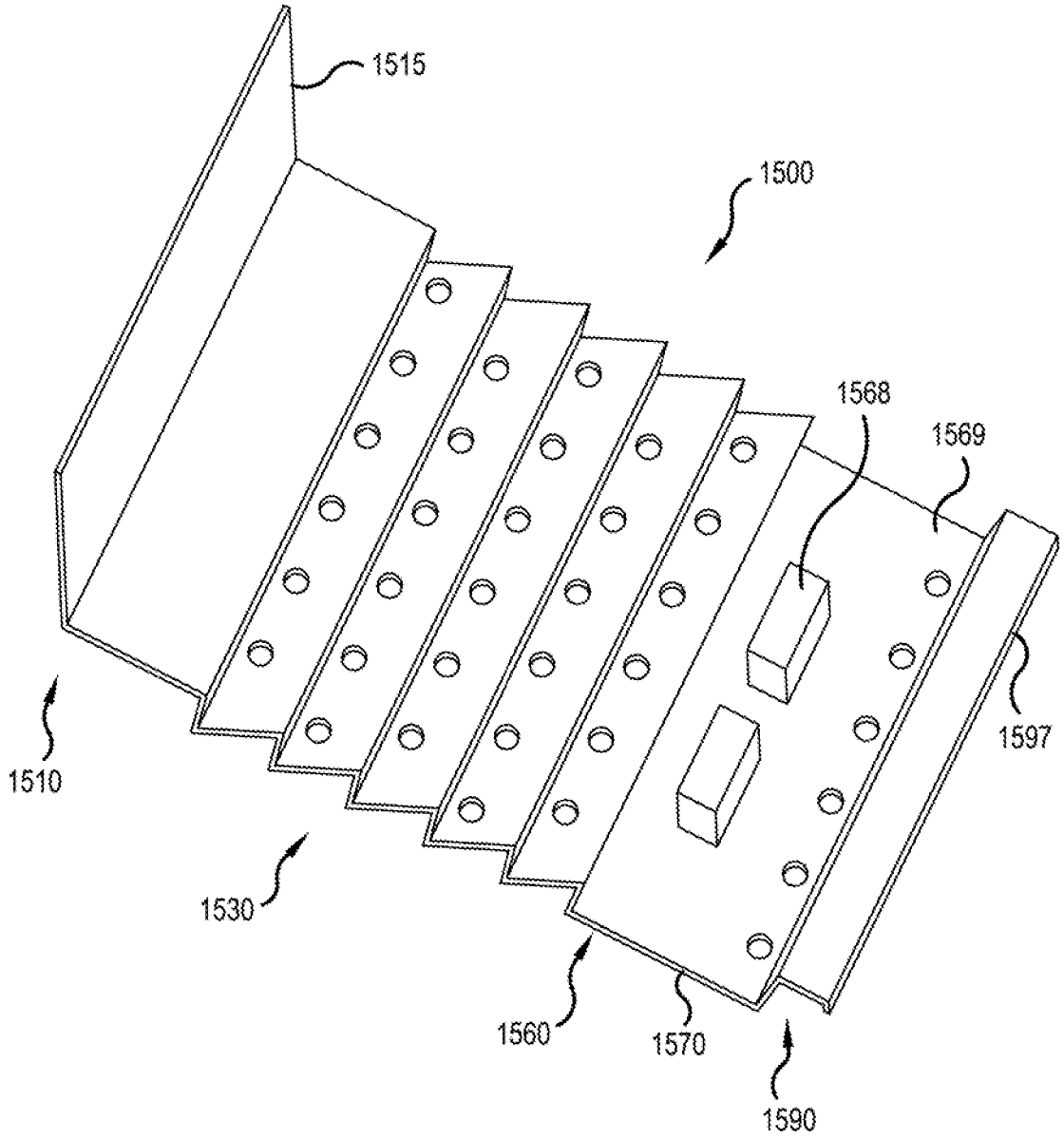
FIG. 15 is an illustration of an exemplary gutter guard with a trough barricade.

FIG. 15 is an illustration of an alternative trough portion of an exemplary single piece gutter guard device 1500. Device 1500 has very similar characteristics to the devices described above, However, an optional roof attachment portion 1510 design with a bendable face is shown. A bent section 1515 terminates roof attachment portion 1510. This configuration of the roof attachment portion 1510 enables attachment to a vertical roof or building section, if so needed. Multiple bends may be devised, according to the installation needs. Gutter lip attachment portion 1590 is also configured with an optional downward (or angled) flap 1597 at its terminal end. This flap 1597 helps to align the gutter lip attachment portion 1590 to the gutter lip (not shown) as well as cause overflowing water to exit further from gutter lip.

Also, the trough portion 1560 is configured with one or more barricades 1568. The barricade(s) 1568 can be formed directly in the trough portion 1560 during manufacturing of the trough portion 1560, or can be added later. For example, the barricade 1568 can be "impressed" into the material of the trough portion 1560 or as a separate material or structure affixed to the trough portion 1560. The barricade 1568 can be located on the top surface 1569 or bottom surface 1570 of the trough portion 1560. As shown in this example, the at least one barricade 1568 is disposed on the top surface 1569 of trough 1560. The topside placement means the barricade 1568 will protrude upward and will aide in preventing debris from remaining on the device 1500. For example, debris can often be wet and when wet will not readily move off the device 1500, especially if resting on a flat surface. However, by having a barricade 1568, it provides an elevated resting surface for debris with open areas lateral to the barricade 1568 and below the debris. The open areas will cause the debris dry out quicker. Being drier, wind and the like will more easily blow the debris off the device. The use of barricades or the like is described in additional detail in pending U.S. patent application Ser. No. 16/864,089, which is incorporated herein.

Figure 16:
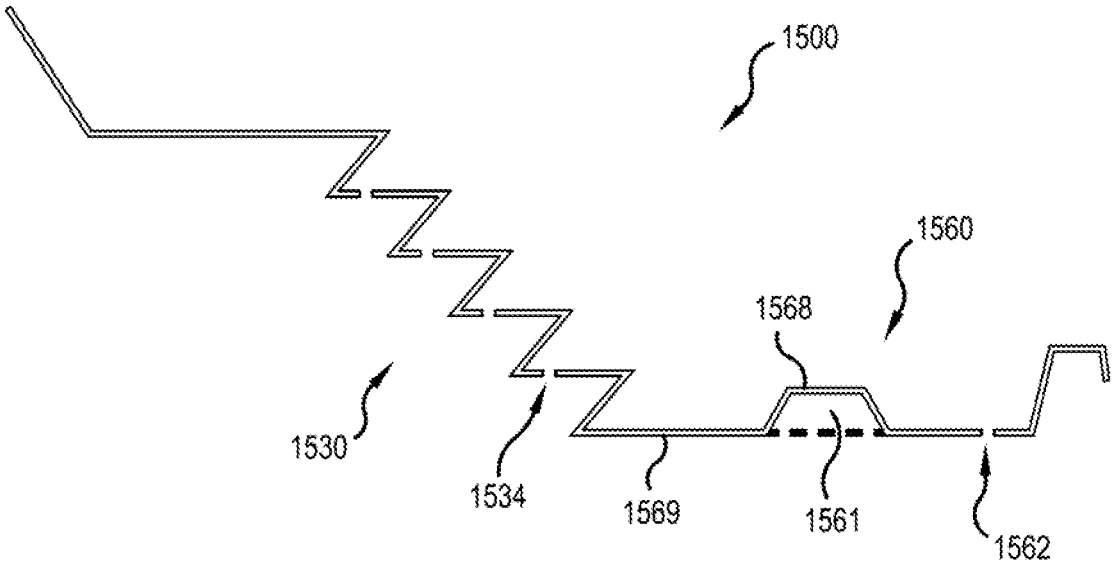
FIG. 16 is a side view illustration of the exemplary gutter guard of FIG. 15.

FIG. 16 is a side view illustration of the gutter guard device 1500. Here, step orifices 1534 can be seen, as well as trough orifices 1562. Barricade(s) 1568 can be an elevated section of the trough 1560 or may be an added material 1561. It should be appreciated that the profile and shape of the barricade(s) 1568 can be different than shown. For example, one barricade of the barricades 1568 may have a different shape as well as a different height than a neighboring or other barricade. Thus, variations to the barricade styles, sizes, shapes, profiles, etc. are understood to be within the scope of this disclosure.

Figure 17:
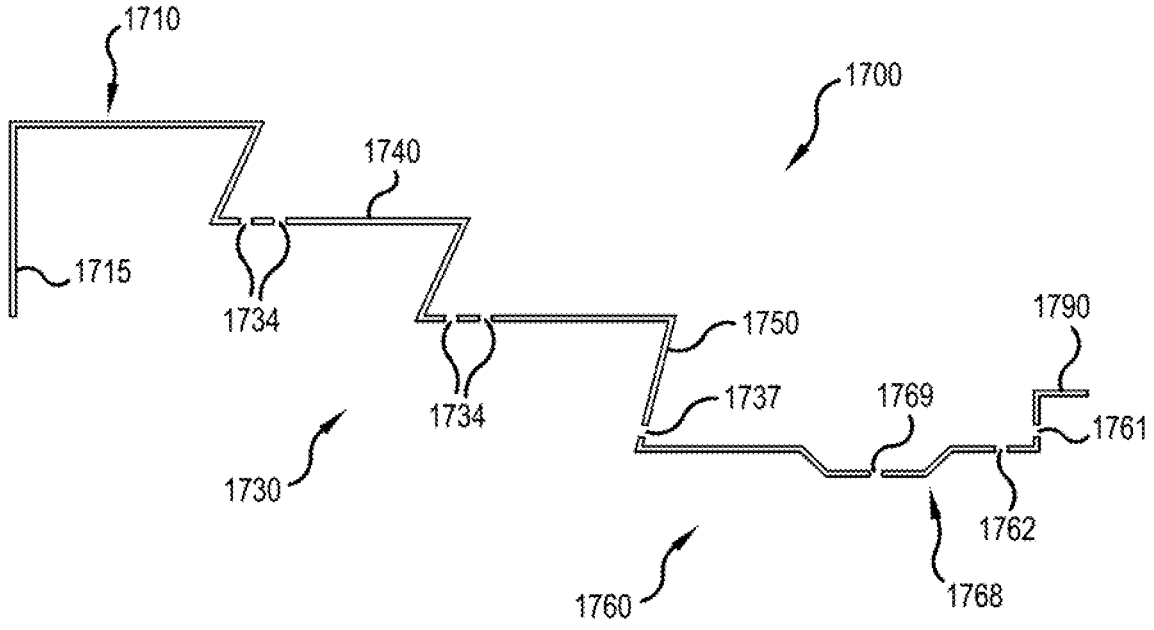
FIG. 17 is an illustration of an exemplary gutter guard with a recessed trough barricade and several variations.

FIG. 17 is another exemplary gutter guard device 1700, with several variations. For example, a non-planar roof attachment portion, very large tread-to-riser ratio, multiple orifices in the treads, side port(s) or orifices in the step(s) and walls of the trough. Further, barricade(s) 1768 is recessed in the trough 1760. Focusing first on the barricade aspect, the recessed barricade(s) 1768 can act as a micro-trough, helping to drain water faster through its barricade orifice(s) 1769. More than one orifice 1769 may be utilized in the barricade (s) 1768. Additionally, as stated above, the barricade(s) 1768 can have different shapes or sizes, etc. For example, the barricade(s) 1768 may have a sloping bottom to help direct water to a respective orifice. Several such barricades may be utilized. Similar to the reasoning stated above, the recessed barricade 1768 is beneficial for rapidly removing debris from the trough 1760, as debris will likely span the barricade's width and therefore air can dry the underside of the debris.

With respect to the large tread-to-riser ratio, this will reduce the number of steps in the step portion 1730. Conversely, a design may be contemplated using a large riser-to-tread ratio, which will produce an increased number of steps in the step portion 1730. Further, different sized steps may be devised. Accordingly, different sized steps, and different riser-to-tread or vice versus ratios can be implemented without departing from the spirit and scope of this disclosure. With respect to the roof attachment portion 1710, it is shown here with an optional downward bent section 1715, enabling attachment to a building wall or roof support, etc. Also, the step portion 1730 contains more than one row or pattern of step orifices 1734 in the respective treads 1740, which may be of similar or different sizes. Further, trough portion 1760 sides are shown with optional orifices 1737 and 1761. Orifice(s) 1761 is on a vertical wall and helps to drain water that is filling the trough portion, acting as a second (or primary) relief for onrushing water. Orifice(s) 1737 is similar but disposed on an opposite wall, in the last step's riser 1750. This orifice 1737 operates like a tread orifice but is on the riser. Finally, gutter lip attachment portion 1790 is relatively flat, not having the optional flap shown in FIG. 15. It is understood that the various modifications or features shown in this Fig. are demonstrative of possible modifications to one or more of the various embodiments described in this disclosure and are not to be limited to the features shown in FIG. 17.

Figure 18:
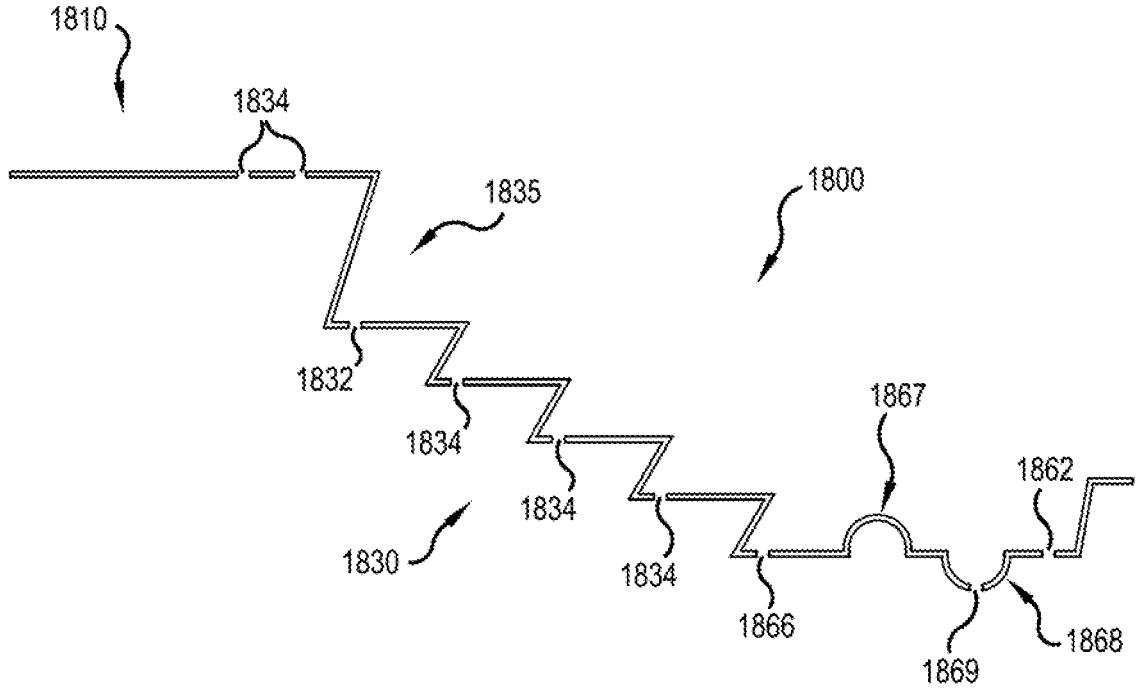
FIG. 18 is a side view illustration of an exemplary gutter guard showing a possible step size variation and a raised and recessed barricade.

FIG. 18 is a side view illustration of an exemplary gutter guard device 1800, showing a possible step size variation and a combination of a raised barricade 1867 and a recessed barricade 568, with corresponding barricade orifice(s) 1869. As alluded above, the step size can be altered within an exemplary device. Here, first step 1835 is larger than the following steps. Of course, depending on design preference, the size difference may be implemented at another location or locations within the step portion 1830. First step 1835 may also have a different sized (or shape) orifice 1832 than the orifices 1834 of the other steps.

With respect to the barricades, they can be reversed in position from what is shown, having the raised barricade 1867 to the right of the recessed barricade 1868. Or, more than one raised, or recessed barricade may be utilized. Of note is the curved profiles of the barricades, which may differ from what is shown and may be dissimilar between barricades, in profile, shape, height, etc. Trough orifice 1862 is shown bordering gutter lip attachment portion 1890. Optional second trough orifice(s) 1866 may be disposed forward to raised barricade 1867, as the barricade 1867 naturally creates a "well" area between the barricade 1867 and the riser of the last step of step portion 1830. The combination of raised and recessed barricades is understood to provide superior drying and debris removal features than a single type barricade.

Of additional note is that roof attachment portion 1810 may have orifices 1834, provided the orifices 1834 are over a gutter opening (not shown). In contrast to FIG. 17's embodiment, this embodiment shows a configuration where the roof attachment portion 1810 is flat and step orifices 1834 are formed as a single row within the step portion 1830. Of course, these features may be altered as desired.

Figure 19:
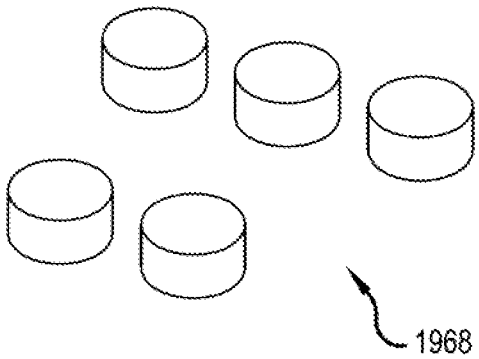
FIG. 19 is an illustration of a barricade formed of a cluster of circular shapes.

As the above Figs. illustrate a handful of barricade forms, it is understood that other barricade forms may be used, according to design preference. For example, FIG. 19 shows a cluster 1968 of six circular barricade shapes that may be used in an exemplary device's trough. The clusters 1968 can be more or less than six objects. The objects within the cluster 1968 can be very small in diameter or large enough so the cluster fills the respective trough. The objects can be recessed (with respective orifices), raised, of any shape including oval, regular or irregular quadrilaterals, regular or irregular polygons, concave or convex contours or a mix of several shapes.

Figure 20:
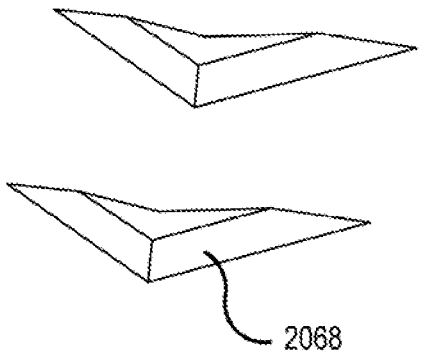
FIG. 20 is an illustration of another barricade shaped as arrow heads.
Figure 21:
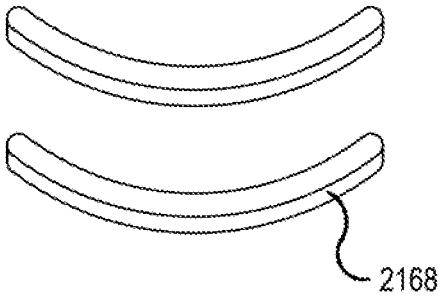
FIG. 21 is an illustration of another barricade shaped as crescents.
Figure 22:
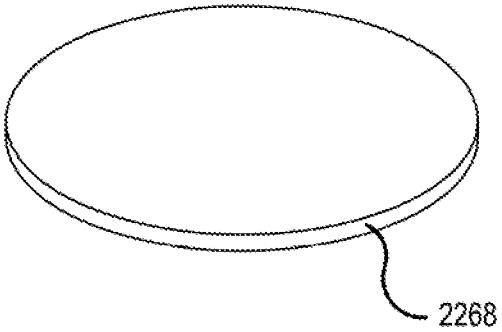
FIG. 22 is an illustration of another barricade shaped as a disc.
Figure 23:
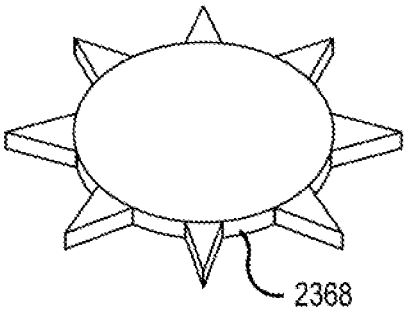
FIG. 23 is an illustration of another barricade shaped as a starburst.

FIG. 20 shows another barricade form formed of "arrow heads" 2068 with angled sides. As stated above, the barricade(s) can be raised or recessed, or combinations of the two. FIG. 21 shows one or more crescent shapes 2168, which can be positioned at any angle, as well as be raised or recessed, or a combination thereof. FIG. 22 shows a single disc 2269 as a barricade. FIG. 23 shows a starburst 2368 as a barricade. As is evident from the above Figs., the barricade may be of any desired shape size, arrangement, or orientation, etc. For example, the barricade can be a letter, number, symbols. With such options, the barricade may even spell out a name, such as the product's manufacturer.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes and combinations thereof may be made without departing from the spirit and scope of this invention. It should be apparent that various different modifications can be made to the exemplary embodiments described herein without departing from the scope and spirit of this invention disclosure. When structures are identified as a means to perform a function, the identification is intended to include all structures, which can perform the function specified.

What is claimed is:

1. A single piece, gutter guard for covering a gutter attached to a building, comprising:

a step section having a step section slope, a roof side and a trough side, having a plurality of connected steps from the roof side to the trough side, wherein each step having a tread and riser;

a trough having a trough slope, a floor, a step section side and a gutter lip side, the trough being integrally connected to a last step of the trough side of the step section and than a tread of the last step, wherein the step section is elevated from the trough and the step section slope and trough slope are not equal to each other;

a gutter lip attachment section integrally coupled to the gutter lip side of the trough; and a plurality of orifices disposed in the trough and in at least one of each tread and riser.

2. The gutter guard of claim 1, wherein the trough and the gutter lip attachment section share a common wall.

3. The gutter guard of claim 1, wherein the floor of the trough is disposed below a top plane of the gutter lip attachment section.

4. The gutter guard of claim 1, wherein a height of the risers and a length of the treads are approximately equal.

5. The gutter guard of claim 1, wherein an angle of junctions between treads and risers is 90 degrees.

6. The gutter guard of claim 1, wherein an angle of junctions between treads and risers is less than 90 degrees.

7. The gutter guard of claim 1, wherein a roof side end of the treads are lower than a trough side end of the treads.

8. The gutter guard of claim 1, wherein the plurality of orifices are disposed in junctions of the treads and risers.

9. The gutter guard of claim 1, wherein the plurality of orifices are disposed proximal to junctions of the treads and risers.

10. The gutter guard of claim 2, wherein the plurality of orifices in the trough are disposed adjacent to the common wall.

11. The gutter guard of claim 2, further comprising orifices disposed in the common wall.

12. The gutter guard of claim 1, wherein the plurality of orifices in the trough are disposed in a junction of the trough and the gutter lip attachment section.

13. The gutter guard of claim 1, wherein the plurality of orifices are at least one row of orifices.

14. The gutter guard of claim 13, wherein the at least one rows are offset from each other.

15. The gutter guard of claim 1, wherein the orifices of the plurality of orifices are non-circular.

16. The gutter guard of claim 1, wherein an outside corner of the plurality of connected steps partially overhangs an orifice in a lower adjacent step's tread.

17. The gutter guard of claim 1, wherein an outside corner of the plurality of connected steps completely overhangs an orifice in a lower adjacent step's tread.

18. The gutter guard of claim 1, wherein an outside corner angle and inside corner angle the plurality of connected steps is less than 90 degrees.

19. The gutter guard of claim 1, wherein a tread width of the treads is greater than a riser height of the risers.

20. The gutter guard of claim 1, wherein one or more steps of the plurality of connected steps is at least one of a different size and different shape than another one or more other steps of the plurality of connected steps.

21. The gutter guard of claim 1, wherein one or more steps of the plurality of connected steps has at least one of a different inside corner and outside corner angle than another one or more other steps of the plurality of connected steps.

22. The gutter guard of claim 1, wherein the last step is at least one of larger, different in shape and different in angle than a first step of the step section.

23. The gutter guard of claim 1, further comprising a barrier in the trough.

24. The gutter guard of claim 23, wherein the barrier is one or more of at least one of raised, recessed and has an orifice in a bottom thereof.

25. The gutter guard of claim 23, wherein the barrier is at least one of formed from the floor of the trough and shaped as at least one of a circle, plurality of circles, rectangle, arrow head, arc, and starburst.

26. The gutter guard of claim 1, wherein a floor of the trough is at a lower elevation than the last step of the step section.

27. The gutter guard of claim 1, wherein the step section slope is negative from the roof side to the trough side.

28. A single piece, gutter guard for covering a gutter attached to a building, comprising:

a step section having a step section slope, a roof side and a trough side, having a plurality of connected steps with treads and risers;

a trough having a floor, a trough slope, a step section side and a gutter lip side, integrally connected to a last step of the trough side, wherein the floor is below the last step of the step section, and wherein the step section slope, rising from the trough side to the roof side, is positive with respect to the trough slope;

a gutter lip attachment member integrally coupled to the gutter lip side of the trough; and a plurality of orifices disposed in the trough and in at least one of each tread and riser of the plurality of connected steps.

29. The gutter guard of claim 28, wherein an angle of junctions between treads and risers is less than 90 degrees.

30. The gutter guard of claim 28, wherein a roof side end of the treads are lower than a trough side end of the treads.

31. The gutter guard of claim 28, wherein the plurality of orifices are disposed in junctions of the treads and risers.

32. The gutter guard of claim 31, wherein the plurality of orifices are disposed proximal to junctions of the treads and risers.

33. A single piece, gutter guard, comprising:

a step section having a roof side, a trough side, a step section slope between the roof side and trough side, and a plurality of connected steps bridging the roof side to the trough side, wherein each step has a tread and riser;

a trough having a trough slope, a step section side and a gutter lip side, integrally connected to a last step of the trough side, wherein the step section slope, from the roof side to the trough side, intersects the trough slope at an angle;

a gutter lip attachment member integrally coupled to the gutter lip side of the trough; and a plurality of orifices disposed in the trough and in at least one of each tread and riser of the plurality of connected steps.

34. The gutter guard of claim 33, wherein an angle of junctions between treads and risers is less than 90 degrees.

35. The gutter guard of claim 33, wherein a roof side end of the treads are lower than a trough side end of the treads.

36. The gutter guard of claim 33, wherein the plurality of orifices are disposed in junctions of the treads and risers.

37. A single piece, gutter guard, comprising:

a step section having a roof side, trough side and a plurality of steps connecting the roof side to the trough side in a declining slope;

a trough having a step section side and a gutter lip side, integrally connected to the trough side of the step section, wherein the step section is elevated from the trough;

a gutter lip attachment member integrally coupled to the gutter lip side of the trough; and a plurality of orifices disposed in the trough and in the plurality of steps.

38. The gutter guard of claim 37, wherein an angle of junctions between treads and risers is less than 90 degrees.

39. The gutter guard of claim 37, wherein a roof side end of the treads are lower than a trough side end of the treads.

40. The gutter guard of claim 37, wherein the plurality of orifices are disposed in junctions of the treads and risers.

* * * * *